United States Patent [19]

Lienard et al.

[11] Patent Number: 4,955,144

[45] Date of Patent: Sep. 11, 1990

[54] COMPATIBLE INTERMODAL ROAD/RAIL TRANSPORTATION SYSTEM

[75] Inventors: Jean Lienard, Ferriere la Petite; Francis Haesebrouck, Versailles, both of France; Sol Katz, New Hope, Pa.; Andrew Abolins, Langhorne, Pa.; George Schmidt, Langhorne, Pa.

[73] Assignees: Strick Corporation, Langhorne, Pa.; Usines et Acieries de Sambre et Meuse, Paris la Defense, France

[21] Appl. No.: 207,109

[22] Filed: Jun. 14, 1988

Related U.S. Application Data

[63] Continuation-in-part of Ser. No. 147,361, Jan. 27, 1988, Pat. No. 4,922,832.

[51] Int. Cl.[5] ..... B61D 17/20

[52] U.S. Cl. ..... 105/4.2; 410/53

[58] Field of Search ..... 105/4.1, 4.2, 159; 410/45, 53, 56

[56] References Cited

U.S. PATENT DOCUMENTS

| | | | |
|---|---|---|---|
| 1,863,575 | 6/1932 | Moncrieff et al. . | |
| 1,921,605 | 8/1933 | Canfield | 214/38 |
| 1,938,049 | 12/1933 | Serrano | 105/215 |
| 2,030,311 | 2/1936 | Messick | 105/215 |
| 2,036,535 | 4/1936 | Nelson | 105/159 |
| 2,039,489 | 5/1936 | Messick | 105/215 |
| 2,043,034 | 6/1936 | Dalton | 105/215 |
| 2,076,503 | 4/1937 | Mussey | 105/4 |
| 2,087,249 | 7/1937 | Fitch | 214/38 |
| 2,127,058 | 8/1938 | Fitch | 214/38 |
| 2,140,885 | 12/1938 | Soulis | 105/215 |
| 2,150,371 | 3/1939 | Furnish | 214/38 |
| 2,166,948 | 7/1939 | Fitch | 105/366 |
| 2,513,552 | 7/1950 | Dove | 105/159 |
| 2,594,734 | 4/1952 | Cripe | 105/182 |
| 2,603,165 | 7/1952 | Cripe | 105/185 |
| 2,691,450 | 10/1954 | Rosenbaum | 214/38 |
| 2,709,969 | 6/1955 | Andert | 105/159 |
| 2,787,971 | 4/1957 | Obes | 105/215 |
| 2,808,289 | 10/1957 | Scoby | 296/35 |
| 2,844,108 | 7/1958 | Madden | 105/159 |
| 2,889,785 | 6/1959 | Browne | 105/215 |
| 2,893,326 | 7/1959 | Browne et al. | 105/4 |
| 2,896,552 | 7/1959 | Obes | 105/215 |
| 2,925,791 | 2/1960 | Browne et al. | 105/215 |
| 2,926,797 | 3/1960 | Decker | 214/38 |
| 2,935,031 | 5/1960 | Cripe | 105/4 |
| 2,954,746 | 10/1960 | Cripe | 105/4 |
| 2,959,303 | 11/1960 | Wheltle | 105/4 |
| 2,963,310 | 12/1960 | Abolins | 294/67 |
| 2,963,986 | 12/1960 | Dobson | 105/4 |
| 3,002,469 | 10/1961 | Wanner | 105/215 |
| 3,028,023 | 4/1962 | Eckersall | 214/38 |
| 3,052,941 | 9/1962 | Abolins et al. | 24/221 |

(List continued on next page.)

FOREIGN PATENT DOCUMENTS

| | | |
|---|---|---|
| 0138450 | 4/1985 | European Pat. Off. . |
| 0143614 | 6/1985 | European Pat. Off. . |

(List continued on next page.)

OTHER PUBLICATIONS

"Requirements for Closed Van Cargo Containers", ANSI MH5.1.1m-1979, published by AMSE, Aug. 31, 1979.

(List continued on next page.)

*Primary Examiner*—Margaret A. Focarino
*Assistant Examiner*—Joseph D. Pape
*Attorney, Agent, or Firm*—Kenyon & Kenyon

[57] ABSTRACT

An intermodal road/rail transportation system wherein the freight containers or road trailers are adapted for transportation on detachable rail trucks or bogies. The system includes various bogie constructions, locking devices and trailer constructions which obviate the disadvantages of the prior art by, among other things, absorbing and/or minimizing the various stresses applied to the system. In the rail mode, the system allows the sequential starting of rail cars, thereby reducing the force necessary to start a string of trailers. The system also includes a variety of compatibility components to allow use of the system with other dissimilar intermodal or bimodal systems and/or conventional locomotives and freight containers.

5 Claims, 34 Drawing Sheets

U.S. PATENT DOCUMENTS

| | | | |
|---|---|---|---|
| 3,111,341 | 11/1963 | Fujioka et al. | 296/35 |
| 3,198,363 | 8/1965 | Snead | 214/502 |
| 3,212,654 | 10/1965 | Dolphin | 214/38 |
| 3,286,653 | 11/1966 | Weber | 105/165 |
| 3,286,657 | 11/1966 | Browne | 105/215 |
| 3,310,185 | 3/1967 | Stricker et al. | 214/38 |
| 3,317,219 | 5/1967 | Hindin et al. | 280/415 |
| 3,342,141 | 9/1967 | Browne | 105/215 |
| 3,368,838 | 2/1968 | Reich | 294/83 |
| 3,387,571 | 6/1968 | Matushek et al. | 105/366 |
| 3,394,662 | 7/1968 | Weber | 105/165 |
| 3,404,444 | 10/1968 | Isbrandtsen | 29/105 |
| 3,433,177 | 3/1969 | Cripe | 105/199 |
| 3,439,822 | 4/1969 | Korodi | 214/516 |
| 3,456,967 | 7/1969 | Tantlinger et al. | 287/2 |
| 3,490,622 | 1/1970 | Brackin | 214/38 |
| 3,556,456 | 1/1971 | Lunde | 248/361 |
| 3,576,167 | 4/1971 | Macomber | 105/368 B |
| 3,577,931 | 4/1971 | Shafer | 105/197 |
| 3,578,374 | 5/1971 | Glassmeyer | 294/67 |
| 3,593,387 | 7/1971 | Georgi | 24/221 |
| 3,606,952 | 9/1971 | Mankey | 214/1 D |
| 3,618,999 | 11/1971 | Hlinsky | 296/35 |
| 3,621,236 | 11/1971 | Hlinsky | 296/35 |
| 4,051,959 | 10/1977 | Staff et al. | 214/38 BA |
| 4,130,208 | 12/1978 | Barry | 214/43 |
| 4,179,997 | 12/1979 | Kirwan | 410/53 |
| 4,196,673 | 4/1980 | Looks | 410/89 |
| 4,202,277 | 5/1980 | Browne et al. | 105/215 |
| 4,202,454 | 5/1980 | Browne et al. | 213/86 |
| 4,208,160 | 6/1980 | Lovgren | 414/347 |
| 4,311,244 | 1/1982 | Hindin et al. | 213/86 |
| 4,316,418 | 2/1982 | Hindin et al. | 105/215 |
| 4,342,264 | 8/1982 | Hindin et al. | 105/215 |
| 4,342,265 | 8/1982 | Hindin et al. | 105/215 |
| 4,381,713 | 5/1983 | Cripe | 105/215 |
| 4,385,857 | 5/1983 | Willetts | 410/53 |
| 4,416,571 | 11/1983 | Krause | 410/53 |
| 4,459,072 | 7/1984 | Schulz et al. | 410/82 |
| 4,478,155 | 10/1984 | Cena et al. | 105/355 |
| 4,547,107 | 10/1985 | Krause | 410/58 |
| 4,597,337 | 7/1986 | Willetts | 105/4 R |
| 4,625,652 | 12/1986 | Losa et al. | 105/4.1 |
| 4,626,155 | 12/1986 | Hlinsky et al. | 410/82 |
| 4,641,399 | 2/1987 | Jackson | 24/287 |
| 4,648,326 | 3/1987 | Jackson | 105/168 |
| 4,651,650 | 3/1987 | Tylisz et al. | 105/218.2 |
| 4,655,143 | 4/1987 | List | 105/168 |
| 4,658,734 | 4/1987 | Mroz | 105/169 |
| 4,665,834 | 5/1987 | Van Iperen | 105/4.1 |
| 4,667,603 | 5/1987 | Van Iperen | 105/4.1 |
| 4,669,391 | 6/1987 | Wicks et al. | 105/4.3 |
| 4,674,411 | 6/1987 | Schindehutte | 105/197.05 |
| 4,674,412 | 6/1987 | Mulcahy et al. | 105/224.1 |
| 4,674,413 | 6/1987 | Eggert, Jr. | 105/224.05 |
| 4,676,172 | 6/1987 | Bullock | 105/168 |
| 4,676,173 | 6/1987 | Mielcarek et al. | 105/209 |
| 4,685,399 | 8/1987 | Baker | 105/4.1 |
| 4,686,907 | 8/1987 | Woollam et al. | 105/4.1 |
| 4,690,069 | 9/1987 | Willetts | 105/224.1 |
| 4,699,065 | 10/1987 | Kibble | 105/199.5 |
| 4,703,699 | 11/1987 | Hill | 105/355 |
| 4,706,571 | 11/1987 | List | 105/168 |

FOREIGN PATENT DOCUMENTS

| | | |
|---|---|---|
| 0209312 | 1/1987 | European Pat. Off. . |
| 0215673 | 3/1987 | European Pat. Off. . |
| 2528782 | 12/1983 | France . |
| 2556288 | 6/1985 | France . |
| 2575115 | 6/1986 | France . |
| 2582589 | 12/1986 | France . |

OTHER PUBLICATIONS

"Blair Retractable Screwdown Twistlock with Third Lock", George Blair & Co. [Sales Ltd.], brochure [not dated].

"Blair Twistlock PD151 Mark 2", George Blair & Co. [Sales], Ltd., brochure [not dated].

"Blair Twistlock P. D. 151", George Blair & Co. [Sales], Ltd., brochure [not dated].

"Blair Twistlock PD149/NRS", George Blair & Co. [Sales], Ltd., brochure [not dated].

"Blair Twistlock PD148/RNS", George Blair & Co. [Sales], Ltd., brochure [not dated].

"Twistlock PD148/RS", George Blair & Co. [Sales], Ltd., brochure [not dated].

"The Road Railer System–MARK IV Bimodal Trailer", Sales brochure of the Chamberlin Group, Inc., 1987.

"The Road Railer System–MARK IV 48′ Dry Van Biomodal Trailer", Sales brochure of the Chamberlin Group, Inc., 1987.

"The Road Railer System–AdapterRailer Transition Vehicle", Sales brochure of the Chamberlin Group, Inc., 1987.

(List continued on next page.)

OTHER PUBLICATIONS

"The Road Railer System-MARK IV 48' Dry Van Trailer with Rail Capacity", Sales brochure of the Chamberlin Group, Inc. 1987.

"The Road Railer System-MARK V High Performance Rail Bogie", Sales brochure of the Chamberlin Group, Inc. 1987.

"ASF Ride Control Trucks", *The Car and Locomotive Cyclopedia,* p. 700.

Frank Richter, "HPIT, What Next?", *Progressive Railroading,* p. 23, Nov. 1987.

"A Fastracker Train with a Rebuilt Streamlined GP-4-0-2 Locomotive", -Fastrack [not dated].

"Rails Raise Intermodal Capacity", *Progressive Railroading,* pp. 35-37, Nov. 1987.

Paul V. Carr, "Intermodal Trends", *Progressive Railroading,* p. 20, Oct. 1987.

"Thrall Puts Growth into Freight Cars", *Progressive Railroading,* pp. 36-38, Oct. 1987.

"Railmaster Testing Nearly Completed", *Trailer/Body Builders,* p. 44 [not dated].

"NTTX The Trailer Train Spine Car a Single-Level 5-Unit Articulated Container Flat Car", *Trailer Train Company,* various dates between Feb. 1, 1985 and Apr. 3, 1987.

"HPIT and Related Integral-Train Concepts/Developments", *Railway Age,* Sep. 1987.

"Growth Through Responsiveness", *Thrall Car Manufacturing Company,* brochure [not dated].

"High Productivity Integral Train Public Presentation", Jun. 23, 1987.

James Cook, *Forbes,* "Open Access", pp. 46-48, Sep. 21, 1987.

Bruce Johnson *Container News,* "Marketing a New Technology", pp. 23-27, Nov. 1987.

COMPATIBLE INTERMODAL ROAD/RAIL TRANSPORTATION SYSTEM

BACKGROUND OF THE INVENTION

This application is a continuation-in-part application of application Ser. No. 07/147,361 filed Jan. 27, 1988, U.S. Pat. No. 4,922,832 entitled Intermodal Road/Rail Transportation System.

The present invention relates to a system of transportation wherein two or more modes of transportation are used to transport freight containers. The potential ID efficiencies and adVantages associated with such a system have been well documented. For example, see U.S. Pat. Nos. 4,385,857 and 4,597,337 to Willetts and U.S. Pat. No. 4,669,391 to Wicks et al.

Generally, the most efficient intermodal transport systems are those which combine rail transport with truck and/or ship transport. The present invention is particularly directed to a rail/road intermodal transport system; however, the freight containers employed in the system of the present invention are also adapted for transport by ship.

This invention pertains to a bogie intended to be placed between the ends of two freight containers, making it possible to transport the freight containers on rails. It is contemplated that the bogie also carries a self-contained train brake unit. The term "freight container" hereinafter indicates any container capable of carrying freight including, but not limited to, road trailers and ISO cargo containers.

The invention also pertains to a rail transportation system including a series of freight containers and a series of bogies of the aforementioned type placed between these freight containers.

The term "road trailer" hereinafter indicates a trailer type freight container that is normally transported by road using a tractor. This trailer has in its rear part one or more running carriages composed of wheels equipped with tires and in its front part means allowing it to be attached in a removable manner to the upper part of the rear chassis of the tractor.

The invention also pertains to locking devices for securing freight containers to bogies.

The invention further pertains to a trailer construction particularly adapted for use in an intermodal transport system.

Freight containers have long been adapted to road/-highway transport. The common truck trailer is an example of a freight container adapted for highway transport. However, the adaptation of freight containers of highway trailers to rail transport has presented problems.

Historically, several distinct approaches have been taken to the problem of transporting, by rail, freight containers which are adapted for highway use (e.g., truck road trailers).

The first such approach is the so called "piggy-back" approach wherein the road trailer is simply secured to a conventional or specially modified flat bed rail car. While this approach is relatively simple, it is inefficient in terms of weight and height.

In accordance with another approach, the rear part of the road trailer is equipped, in addition to the road running carriages, with a railroad axle having wheels adapted to travelling on rails. This railroad axle is normally kept in a position in Which its wheels are located above wheels equipped with tires. These railroad wheels can be lowered to a level under the wheels equipped with tires to make travel on rails possible.

The front part of the trailer includes a rigidly attached drawbar so that it can be coupled to the rear of another identical trailer.

One drawback of this device lies in the fact that the presence of the railroad wheels makes the trailer considerably heavier.

Another approach is to support the ends of the freight containers on rail-trucks or bogies such that the freight container and bogie together act as a railroad car. This approach offers advantages in terms of height and weight by obviating the need for a flat deck supporting structure on which the containers are set. On the other hand, because the engine pull force and braking forces are transmitted through the freight containers, the freight containers are subject to forces resulting from the engine pull, the braking of the bogies and train forces.

Conventional truck trailers are not strong enough to withstand these forces. Accordingly, either the freight container or flat car deck used in connection with this approach must be specially designed and reinforced to withstand the torsional, tension and compression forces as well as the twisting moments resulting from engine pull, braking and uneven rails. A number of problems associated with prior bogie-type intermodal systems, such as those Cited above, can be traced to a failure to adequately deal with these forces.

For example, in one construction the rear part of the road trailer is supported on a railroad bogie, through the use of a pivot. See e.g., U.S. Pat. No. 4,597,337. According to this solution, the trailers are coupled together using a rigidly attached drawbar which is also used to support the vertical load of the trailer located at the back of the bogie.

One disadvantage of this solution lies in the fact that the engine draft and buff forces are applied at the transverse center of the freight container which is typically the weakest point thereof rather than at the sides of the freight container which are strongest. Thus, application of force at the transverse center of the freight container necessitates additional reinforcement and/or provision of a force transfer means, thereby increasing the weight of the freight container.

Additionally, prior bogie designs have allowed play between the freight container and the bogie in an attempt to accommodate twisting freedom between them. This play, however, results in relatively quick wear of the components, and, accordingly, in the past, only a limited amount of play, and consequent accommodation, has been feasible.

Further, the operations for placing the trailers on rails, coupling the trailers and separating them are complex and costly. These operations indeed require heavy and complex handling equipment.

In the past, the respective freight containers have often been rigidly mounted to one another in order to avoid undesirable resonances. Although a rigid coupling is advantageous in some respects and widely employed throughout the railroad industry, it presents a significant disadvantage in the starting of the train convoy (string of rail cars) by the locomotive. More specifically, if each rail car of the convoy is rigidly coupled to one another, the locomotive must supply sufficient force to simultaneously initiate movement of each car in the convoy or string of trailers. Since a greater force is needed to initiate movement of the cars than to keep them moving, a maximum amount of drive force is required to begin movement of the train. While this problem could be overcome through the sequential starting of the cars by providing the slack connections between the cars, sequential starting is not practical in conventional arrangements, for example, because such slack would result in undesirable resonances between the cars.

Other solutions have been described, especially in French Pat. No. 2,556,288 and U.S. Pat. Nos. 3,576,167, 4,669,391 and 4,687,399. None of the known solutions is truly satisfactory.

As noted above, many of the problems associated with previous attempts to employ rail trucks or bogies to support freight containers for rail transport may be broadly attributed to inadequate treatment of the forces acting on the containers resulting from a failure to recognize and appreciate the source and/or severity of these forces or to conceive of a solution for handling them in a practical manner.

SUMMARY OF THE INVENTION

The present invention is directed to an intermodal transport system wherein the freight containers are adapted for transport on rail trucks or bogies as well as on roads which obviates the disadvantages of the prior art. More specifically, the present invention is directed to an intermodal road/rail system in which the forces applied to the freight container are applied at the point of maximum strength of the freight container, in which the twisting moment between the bogies and the freight containers is substantially reduced and/or compensated for and in which the bogie system allows articulation with greatly reduced wear between the trailer and bogie. Further, the present invention is directed to a system which permits sequential starting of the rail cars thereby reducing the force required to initiate movement of the train convoy without generating undesirable resonances.

The present invention is also directed to an intermodal transport system which is compatible with conventional locomotives and freight cars and also compatible with conventional intermodal or bi-modal transport systems.

Thus, an object of this invention is to solve the problems of known embodiments by creating a bogie that makes it possible to practically couple road trailers and to enable the transportation of these trailers on rails under improved conditions.

Another object of the invention is to create an intermodal rail transportation system which is compatible with conventional intermodal or bi-modal systems, especially the aforementioned drawbar type intermodal or bi-modal systems.

Another object of the invention is to create a rail transportation system including a series of road trailers and a series of bogies between these trailers supporting the latter, with this series of bogies being suitable to absorb the traction and compression stress exerted on the string of trailers, rocking, pitching and zig-zag movements of the trailers, and the imperfections in the railroad tracks.

A further object of this invention is to provide a bogie construction which minimizes the creation of twisting stresses or moments.

Another object of the invention is the provision of improved locking devices for securing the trailer to the bogie.

A further object of the invention is the provision of an improved trailer which can be connected to the bogies regardless of front-aft orientation and either pushed or pulled.

A further object of the invention is the provision of an improved positioning and support arrangement for the running gear and step guard of the trailer.

The intermodal transport system of the present invention has five principal components, a bogie or rail truck, a trailer type freight container, a locking mechanism for selectively attaching the freight container to the bogies, running gear for roads, and an adapter car. The system also includes a number of compatibility components such as transition cars, flat car adapters, adapting trailers and adapter bolsters. Each of these components contains unique features which permit the system as a whole to achieve the desired results.

According to one embodiment of the invention, the railroad bogie intended to be placed between the ends of two road trailers includes a rigid chassis mounted on railroad wheels, with each of the two ends of this chassis having a bolster support to accommodate a trailer end, with this bolster support having means to attach said end of the trailer to the bolster in a removable manner, with each of the two bolsters being connected to the bogie chassis by fastening means that allow a certain freedom of movement of these supports with respect to the bogie chassis around the three following axes: the axis perpendicular to the horizontal plane of the chassis, the axis parallel to the longitudinal axis of the chassis and the axis perpendicular to the other two axes (i.e. perpendicular to the vertical longitudinal plane of symmetry of the bogie chassis). Such movement has heretofore been thought to be undesirable or unachievable in a practical construction.

Because of these movements of the two bOgie supports which accommodate the ends of two trailers, the latter can follow movements that may be generated while they are travelling on rails, for example, due to curves, distortion of the rails, pitching and rocking movements, load differences in the trailers, and the like. Further, by providing the fastening means proximate the uppermost surface of the bolsters, the twisting moment generated by the drive force is minimized.

According to an advantageous embodiment of the invention, means are provided to damp the movements around the three aforementioned axes. The shook absorbing means may comprise surfaces cooperating mutually by friction.

The shock absorbing means thus make it possible to restrain the rotation, zig-zag, pitching and rocking movements mentioned above from creating continuous oscillations that may detract from the stability of the string of trailers on the rails as well as the stability of the equipment overall.

Preferably, the aforementioned fastening means also allow the supports to have some sliding movement restrained by friction in the direction of the longitudinal axis of the chassis. The sliding with friction allows the bogie to absorb the longitudinal traction and compression movements exerted on the string of trailers during starting and braking.

Elastic adjusting means are preferably provided to keep the supports in a resting position perpendicular to the longitudinal axis and also to the transverse axis of the chassis.

The elastic adjusting means contribute to improving the stability of the string of trailers as it moves on the tracks.

According to further embodiments unique locking devices are provided for securely connecting the trailer to the bogie.

According to another aspect of the invention, the running gear of the trailer are longitudinally slidably mounted to the trailer and pin means are provided for selectively fixing the position of the running gear along the bottom of the trailer.

The trailer of the present invention also includes a step guard which can be selectively repositioned from the desirable road mode position to a desirable rail mode position to avoid interference with the bogie. More specifically, the step guard can be either slidably or pivotably mounted to the rear of the trailer.

The invention also contemplates alternative bogie constructions in which the twisting moment is absorbed and/or minimized.

Further special characteristics and advantages of the invention will appear from the description below in which similar numerals are applied to similar structures.

DETAILED DESCRIPTION OF THE INVENTION

Figure 1:
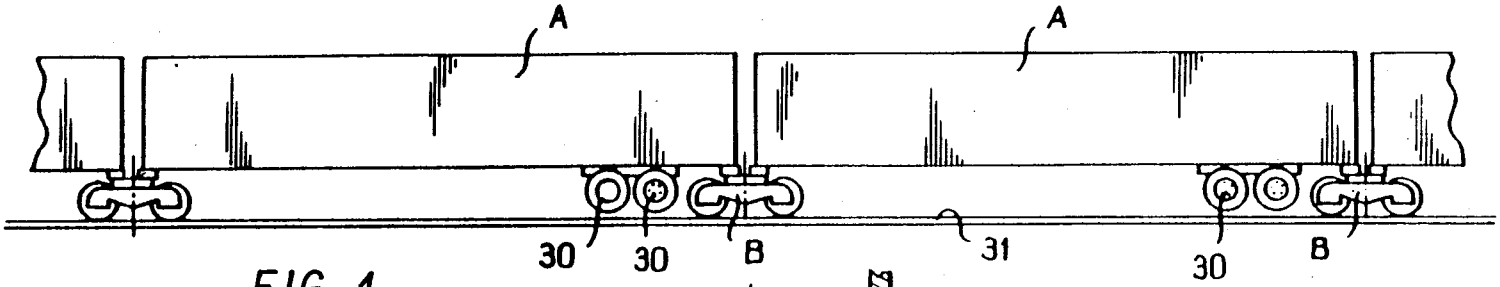
FIG. 1 is a side view of a series of road trailers supported by railroad bogies according to the invention.

FIG. 1 shows a string of trailer type freight containers A. To run on the road, they have at their rear part wheels 30 equipped with tires.

The rear and the front ends of the trailers A are shown carried by railroad bogies B running on rails 31, which hold the wheels 30 of the trailers A at sufficient distance above these rails 31.

Each bogie B includes (see FIGS. 4, 5, 6, 7) a rigid bogie chassis composed of two sole bars or side frames 1 connected by a center tube 2, and this chassis is mounted on railroad wheels 32 through the use of a spring suspension. A self-contained train brake unit (not shown) is mounted on the outside of the side frame. Each of the two ends of this chassis includes an upper cross piece or bolster 8 which includes a bolster support end portion E to accommodate one end of the trailer A.

The end portion E has attaching means to be described in greater detail below, to attach the trailer end A to this support E in a removable manner.

Figures 8, 9:
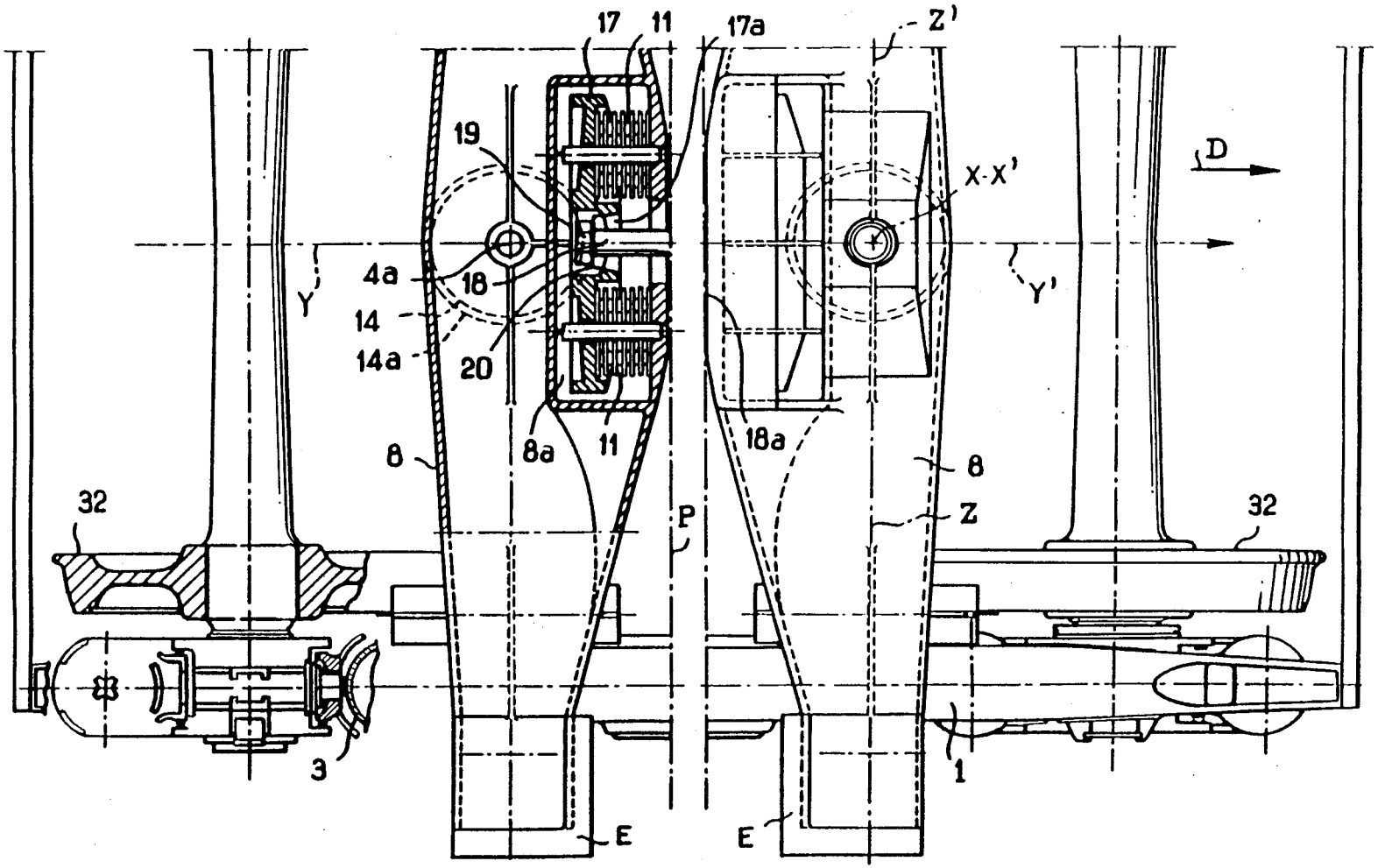
FIG. 8 is a half cross section view along line VIII—VIII in FIG. 4.
FIG. 9 is a half top view of the bogie.
Figure 10:
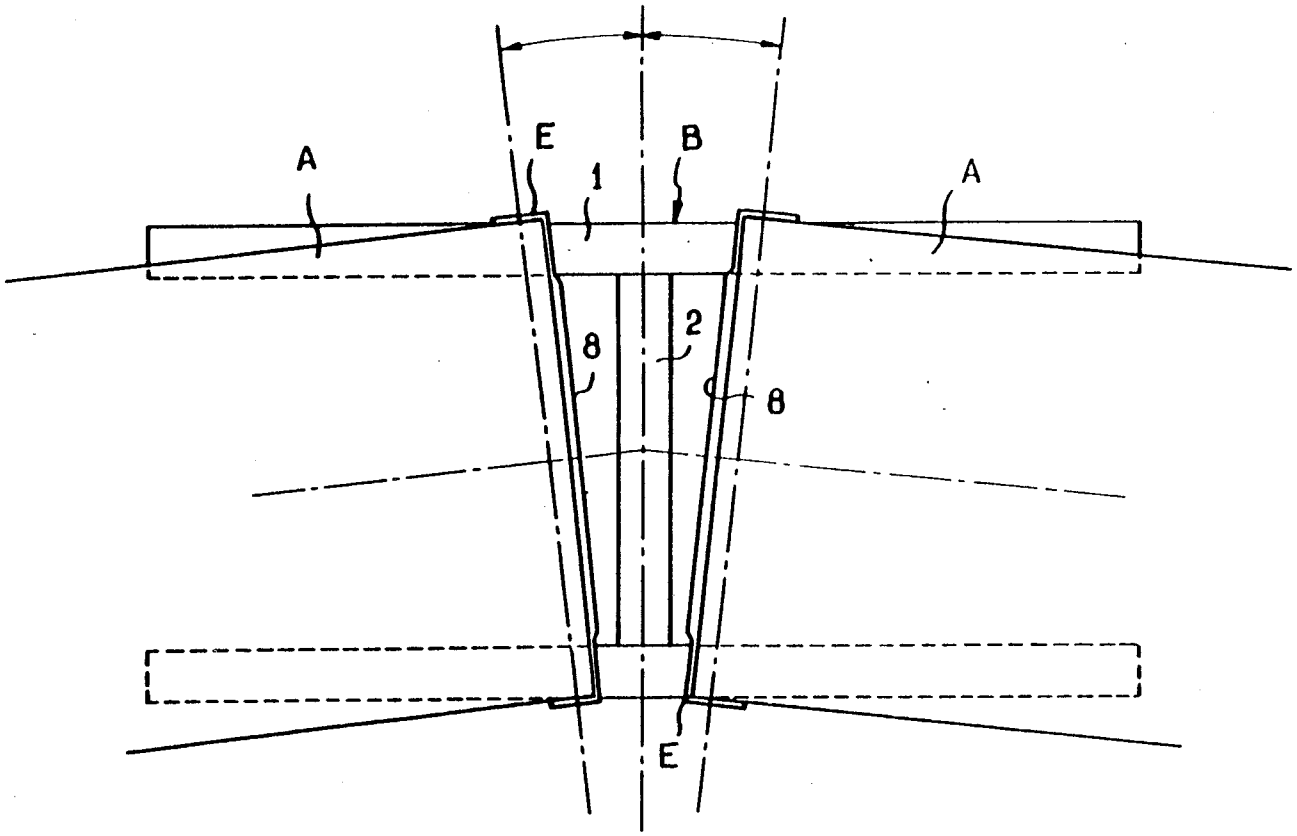
FIG. 10 is a top view of the rear of two adjacent trailers positioned on a bogie showing the limit angle formed between the two supports of this bogie.

Each of the two bolster supports 8 is connected to the bogie's chassis 1, 2 using fastening means allowing a certain freedom of movement of these supports 8 with respect to the chassis around the following three axes: the X—X' axis, perpendicular to the horizontal plane of the chassis, the Y—Y' axis, parallel to the longitudinal axis D (see FIG. 9) of the chassis, and the Z—Z' axis, perpendicular to the vertical longitudinal plane F (see FIG. 8) of symmetry of the chassis.

In the embodiment shown, the rail bogie also include a lower cross piece or bolster consisting of a lower component 4 perpendicular to the longitudinal axis D of the chassis and attached to the two side frames thereof.

The upper cross piece or bolster component 8 intended to accommodate an end of a trailer A is supported on the lower bolster support. More specifically, the upper component 8 includes in its center a support surface 14 in the shape of a sphere segment (see FIGS. 5, 6, and 7) whose concavity is directed downward and which rests on a support surface 14*a* having a complementary spherical shape to constitute a pivot with a substantially vertical axis X—X'. This support surface 14*a* is part of a component 6 placed between the lower cross piece or bolster 4 and the upper cross piece or bolster 8.

A fitting 6*a* made of material having a high friction coefficient (such as the material used to make fittings for automobile brakes) is inserted between the two sphere segments 14 and 14*a*. The fitting 6*a* makes it possible to absorb the rotational movement around the X—X' axis of the pivot formed between the upper B and lower 4 bolster components.

Figures 4, 5:
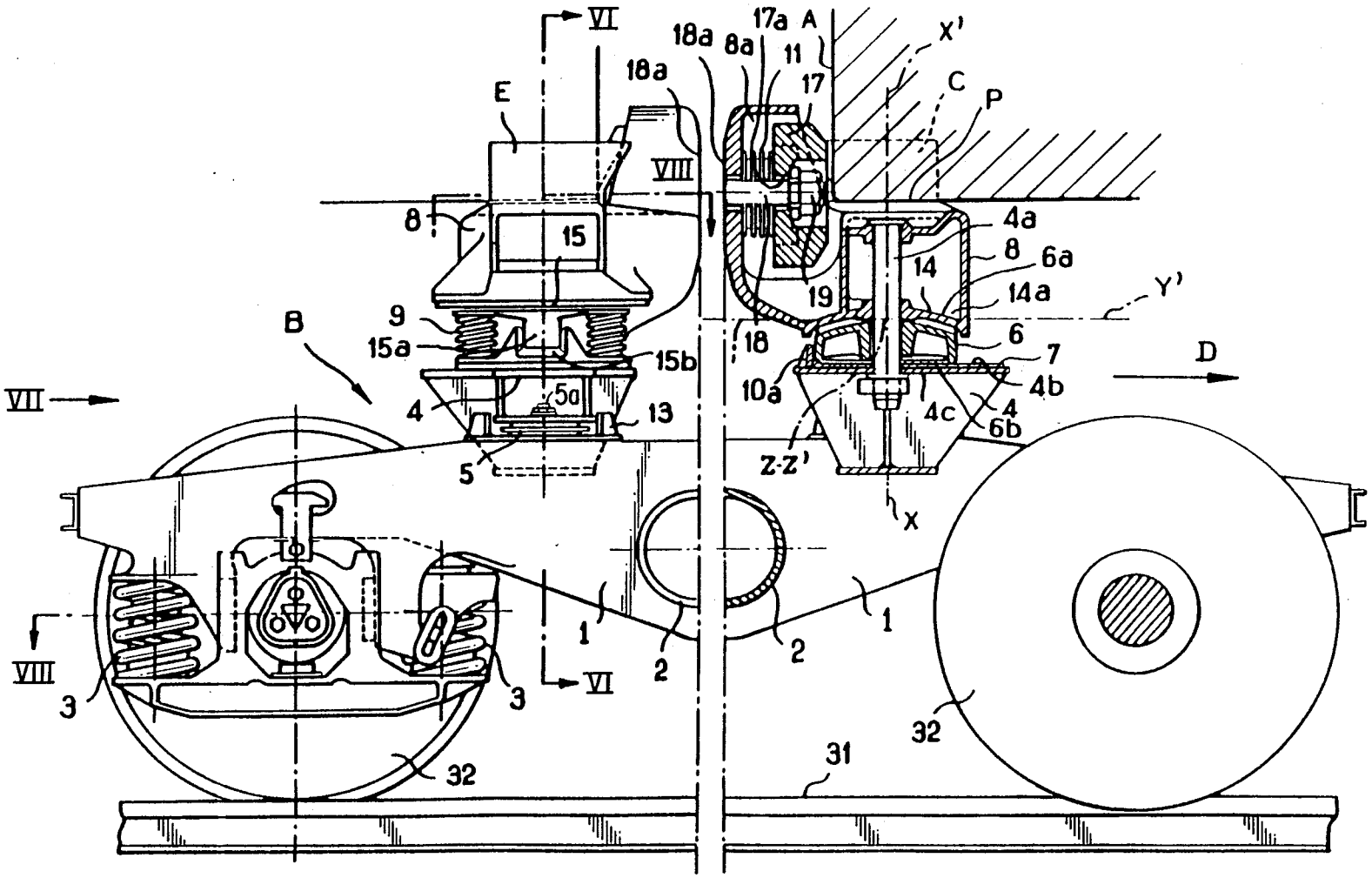
FIG. 4 is a half-side view of a bogie according to the invention.
FIG. 5 is a half cross section view along the longitudinal plane of symmetry of the bogie, showing the rear end of a trailer in position on a bogie support.

FIG. 5 also shows that the two lower 4 and upper 8 bolster components are connected together by a shaft 4*a* passing vertically through the two sphere segments 14, 14*a* with a certain clearance so that the two components 4 and 8 can pivot slightly around the Z—Z' axis.

The fitting 6*a* supports the weight of the end of the trailer so that the shock absorbing effect of the rotational movements around the X—X', Y—Y' and Z—Z' axes increases with the load, which is beneficial.

Moreover, the component 6 which holds the sphere segment 14*a* rests on the lower component 4 through the intermediary of two surfaces 6*b* and 4*b* making possible a certain sliding between them along the longitudinal axis D of the chassis. These two sliding surfaces 6*b*, 4*b* are covered with a wear-resistent coating 7, for example, made of special steel containing manganese.

On the other hand, the sliding between the two surfaces 6*b*, 4*b* is guided by lateral stops 10 (see FIGS. 6 o and 7) parallel to the longitudinal axis D of the chassis and is limited by stop 10*a* (see FIG. 5) perpendicular to the aforementioned axis D and adjacent to the center of the 13 chassis. To make this sliding possible, an opening 4*c* elongated in the direction of the longitudinal axis D of the chassis (see FIG. 5) is placed in the lower cross piece 4, for the passage of the vertical axis 4*a* connecting this component 4 to the upper component 8.

Figures 6, 7:
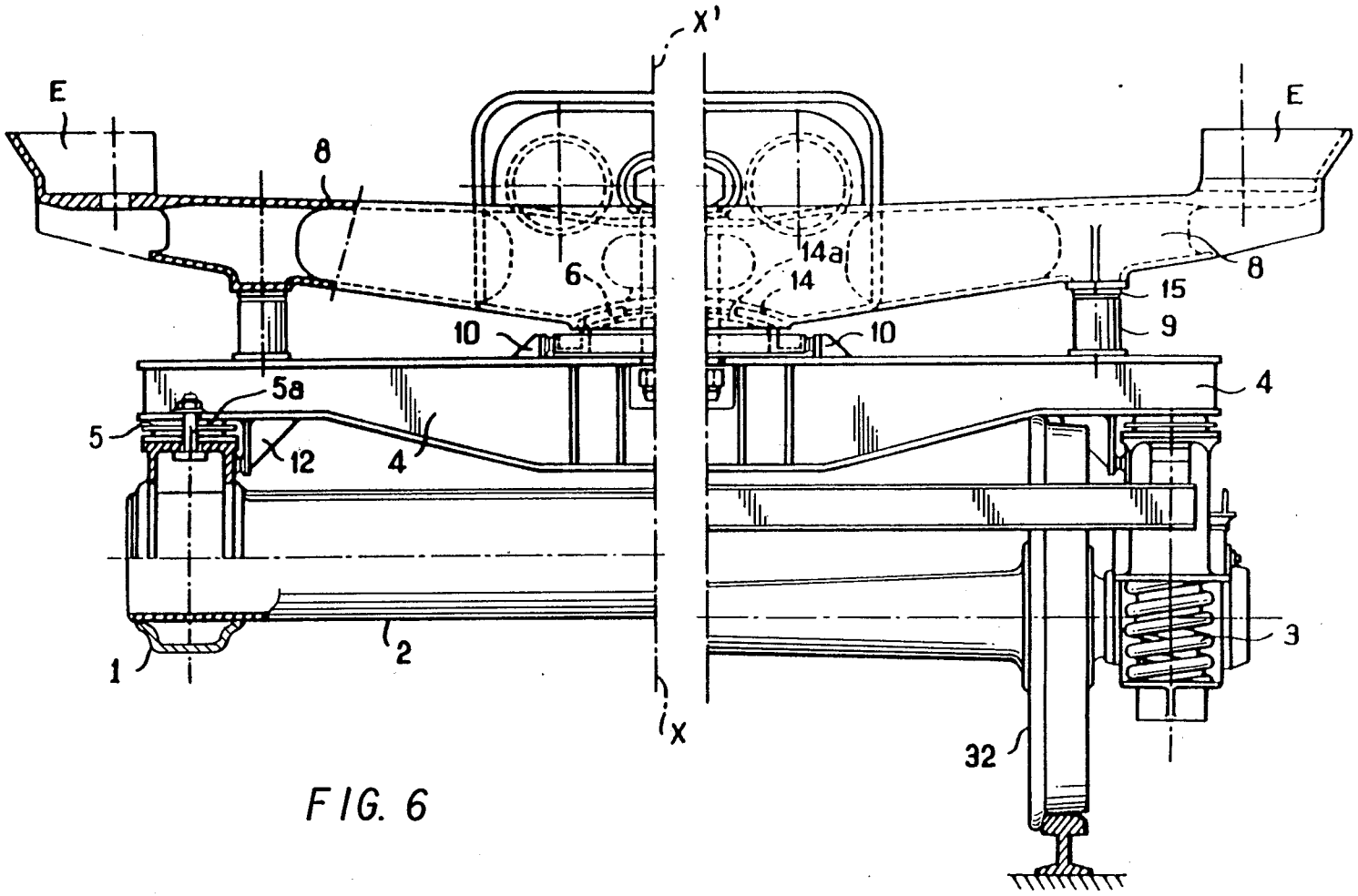
FIG. 6 is a half cross section view along line VI—VI of FIG. 4.
FIG. 7 is a half view along arrow VII in FIG. 4.

Moreover, FIGS. 4, 6 and 7 show that the opposite ends of each upper cross piece or bolster 8 rest on the lower cross piece or bolster 4 with elastic support components 9 including in their upper part support surfaces 15 allowing a relative sliding between these two elements 8 and 4.

The elastic support components 9 are composed of springs. These springs are kept from deflecting in the direction of the axis D by projections 15*a* connected to the support surface 15, engaged in the groove 15*b* of a shoulder resting on the lower component 4.

The springs of the elastic components 9 exert a predetermined force on the support surface 15 in contact with the upper cross piece.

A fitting having a high friction coefficient is inserted between the support surface 15 and the adjacent surface of the component 4.

The supporting force exerted by the springs 9 thus determines a definite level of friction which absorbs the oscillations of the upper cross piece 8 around the X—X' axis. This friction is independent of the load on the trailers A and thus is present even when said trailers are empty.

FIGS. 4, 6 and 7 show on the other hand that the opposite ends of the lower cross pieces or bolsters 4 rest on the two side frames of the chassis via blocks 5 made of elastic material such as rubber, attached to the side frames 1 and to the lower components 4 with bolts 5*a* that pass through these blocks 5 vertically.

Stops 12 and 13 are provided on the lower components 4 and on the side frames 1 of the chassis to limit the movements of these components 4 with respect to the chassis in the longitudinal direction D and in a transverse direction with respect to the preceding.

Moreover, each upper cross piece or bolster 8 has a support surface 18*a* located in a plane perpendicular to the longitudinal axis D of the chassis and passing substantially through the center thereof. This surface 18*a* presses against a corresponding support surface of the other bolster 8.

Each bolster 8 includes (see FIGS. 5 and 8) a housing 8*a* adjacent to the support surface 18*a* in which is placed an elastic component 11 connected to the elastic component 11 placed in the housing 8*a* of the other upper bolster 8 by a shaft 18 that passes through the two adjacent support surfaces 18*a* (see especially FIG. 11) so as to compress them laterally against each other.

The shaft 18 connecting the elastic component 11 of one of the bolsters 8 to the other bolster is substantially parallel to the longitudinal axis of the chassis and substantially in the plane of the support surface of these bolsters which accommodates the end of a trailer A. Thus, traction or compression stress exerted between trailers A does not generate any moment of forces tending to make the bolsters 8 sway.

The elastic components 11 are adapted so that the upper bolsters B can move in the direction of the longitudinal axis D of the chassis when the string of trailers is set into motion under the effect of the traction exerted by the locomotive. The compressibility of the elastic components 11 is calculated to obtain a sufficient displacement of the components 8 to allow the successive separation of the trailers.

Successive separation of the trailers considerably reduces the traction force needed to initiate movement of the string of trailers A. In particular, as discussed above, when the movement of the trailers is sequentially initiated, the locomotive need only supply enough force to initiate movement of one car at a time and enough force to keep the moving cars moving. Since a greater force is needed to initiate movement of the cars than to keep them moving, sequential starting of the cars requires less locomotive force than simultaneous starting of the cars.

The longitudinal compression stress generated during braking is transmitted via the surfaces of contact 18*a* between the upper bolsters.

While it is believed that this arrangement adequately absorbs the forces generated during braking, it should be noted that in the arrangement shown in FIG. 5, the braking force is carried through one bolster. Since the force is carried through one bolster, a twisting moment is generated at the locking device. This movement might preclude use of a no play twistlock (described below).

Figure 18:
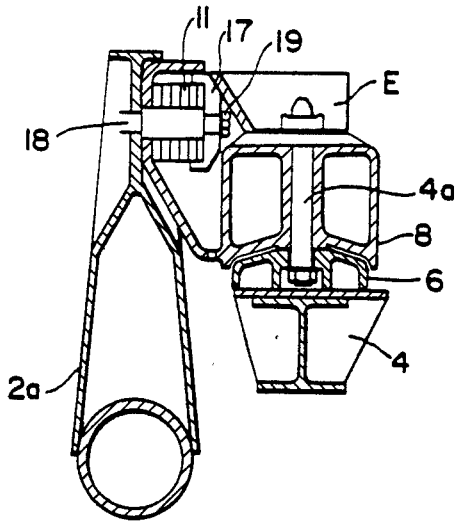
FIG. 18 is a cross section showing a possible modification of the bogie of FIG. 5.

FIG. 18 shows one possible modification of the bogie for eliminating or minimizing the moment generated so as to permit the use of a no-play locking device to secure the trailer A to the bolster E. More specifically, in FIG. 18 a load transfer center connector 2*a* is secured to or formed integrally with center tube 2.

The load transfer center connector 2*a* extends vertically upward between the support surfaces 18*a* and the shaft 18 and passes through an upper portion of the center connector 2*a*. By providing the load transfer center connector 2*a* as shown in FIG. 18, the braking force bypasses the bolsters and avoids transferring the braking force through the bolsters. Thus, no twisting moment is produced and a no play locking device may be used.

On the other hand, it is seen that the support surfaces 18*a* of the two adjacent cross pieces or bolsters 8 are flat surfaces bordered on each side by two flat surfaces forming a dihedron with the corresponding flat surfaces of the other bolster, with this dihedron diverging towards the end of these components. This arrangement allows the adjacent bolsters 8 to pivot towards each other as shown in FIG. 11.

In the example shown, each elastic component includes two rubber blocks reinforced with metal plates located on either side of the shaft 18 and compressed by the latter via a common shoulder 17 towards the adjacent bolster 8.

Each shoulder 17 has an opening 17*a* for the passage of the shaft 18, having a section greater than the diameter of this shaft 18, with this opening 17*a* bordered by a spherical surface which supports the complementary spherical surface of a washer 20 inserted between the heads 19 of the shaft 18 and this spherical surface which borders the opening 17*a*.

Figure 11:
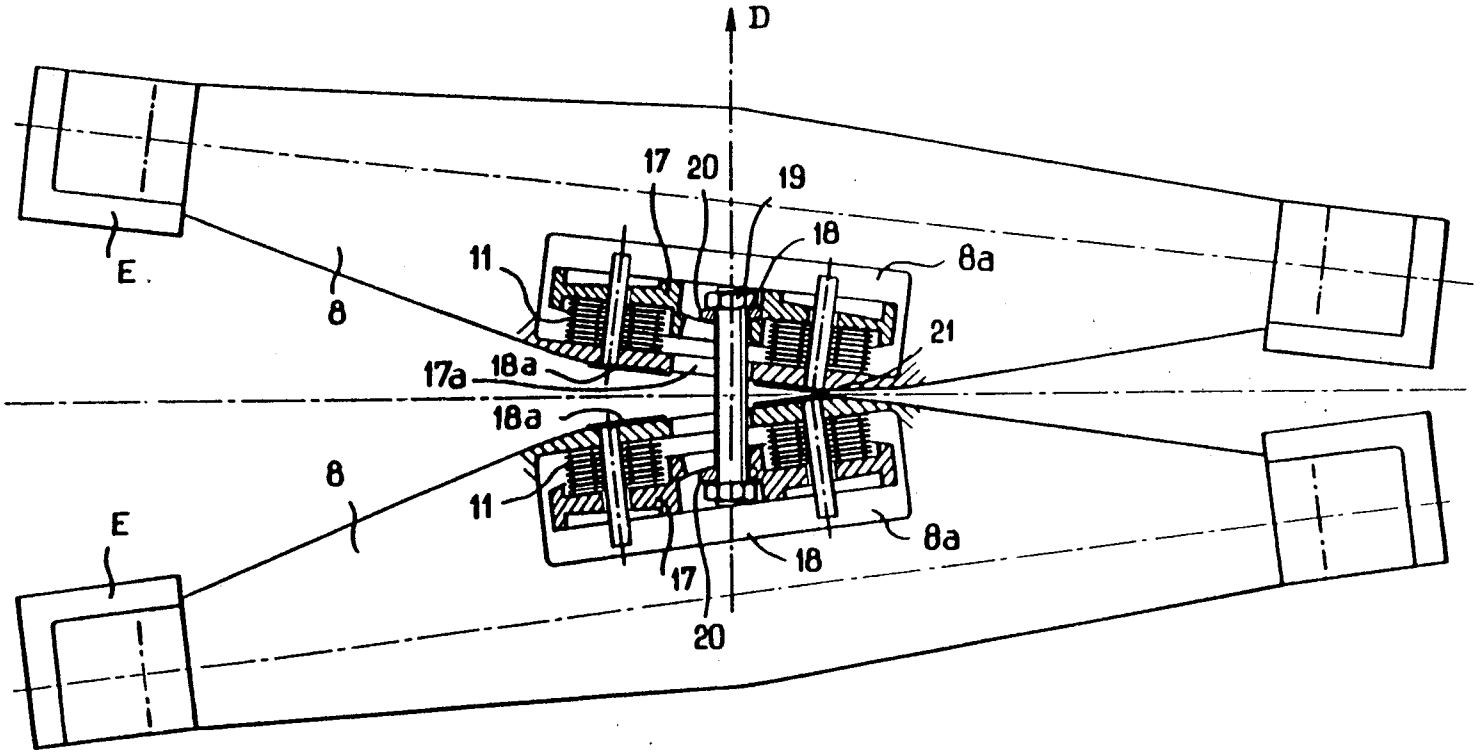
FIG. 11 is a top view with partial cross section of the two bogie supports in the position shown in FIG. 10.

Moreover, the flat support surface 18*a* of each upper bolster 8 includes a layer of a wear-resistent material, such as a special steel containing manganese, as shown especially in FIG. 11.

The device described above operates as follows:

When longitudinal traction is exerted on the trailers A, the ends of the trailers A attached to the upper bolsters 8 can move apart. During this movement, the elastic blocks 11 are compressed and absorb the traction stress.

The bolsters 8 can also move apart by the sliding of the surface 6*b* of the component 6 on the surface 4*b* of the lower bolster 4.

During braking, the ends of the trailers are pressed together, which causes the bolsters 8 to lean one on the other via surfaces 18*a*. This support does not provide any elasticity, which prevents an "accordion" effect and these blocks thus absorb the compression stress.

For curves, the upper bolsters 8 to which the trailers are attached and can each pivot around the X—X' axis.

When this rotation occurs, the elastic blocks 11 work in compression, as indicated in FIG. 11, since the two flat surfaces in contact 18*a* press against each other along a vertical line 21 located at the end of these surfaces. This compression generates a moment of forces which tends to move the bolsters 8 back towards a position perpendicular to direction D. This return moment is absorbed by the friction surfaces between the spherical surfaces 14 and 14*a* and between the flat surfaces 15, which makes it possible to prevent oscillations that may generate zig-zag movements.

The upper bolsters 8 can also pivot independently from each other around the Y—Y' axis parallel to longitudinal direction D.

These upper bolsters 8 can also pivot independently from each other around the Z—Z' axis, which is perpendicular to the X—X' and Y—Y' axes.

Consequently, the bogie according to the invention can absorb traction and compression stresses, it can follow curves While at the same time generating a return moment of forces in the longitudinal direction D, it can follow rotating movements around the three axes X—X', Y—Y' and Z—Z', perpendicular to each other, with all of these movements being absorbed to prevent any risk of untimely oscillations that may compromise the stability of the unit. Thus, the bogie can limit any excessive rocking, pitching and zig-zag movements.

The elastic blocks 5 inserted between the lower bolsters 4 and the side frames 1 of the chassis make it possible to absorb torsion due to distortion of the railroad tracks that may affect the mechanical stability of the bogie unit.

In certain instances, the use of bolt such as that shown at 18 and 19 in FIGS. 5–11 may be regarded as disadvantageous. In such instances it may be desirable to employ the alternative bolster construction illustrated in FIGS. 45–50.

Figure 46:
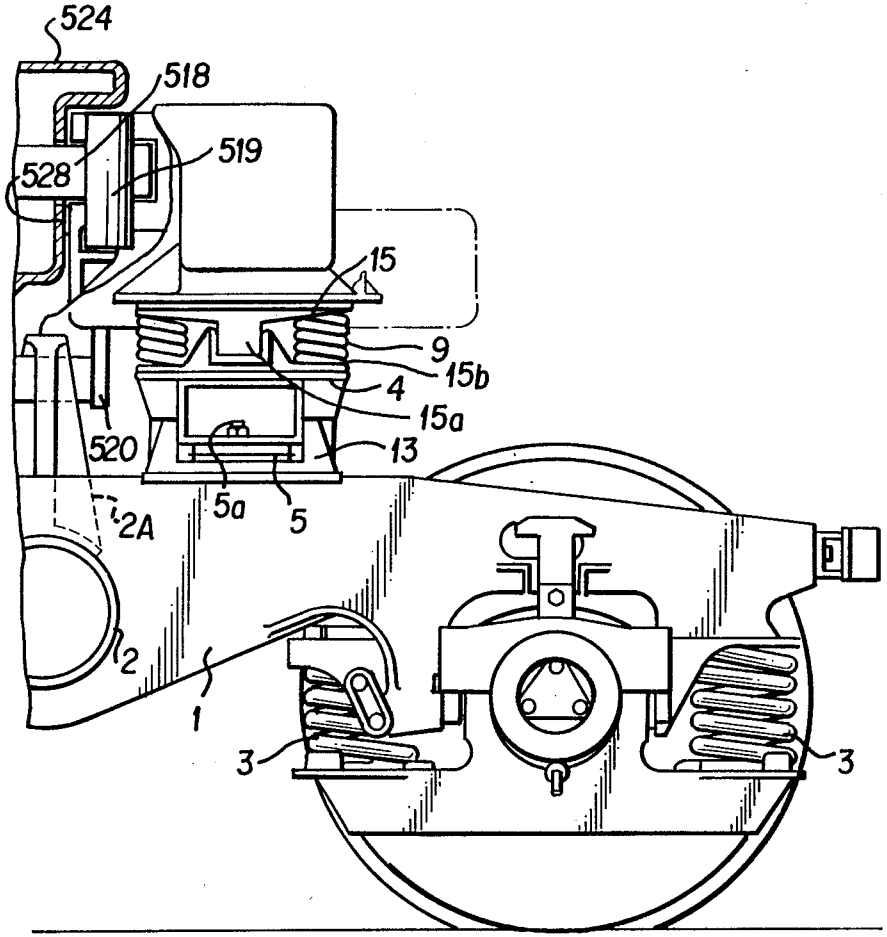
FIG. 46 is a half cross-section along the longitudinal plane of symmetry of the bogie.
Figure 45:
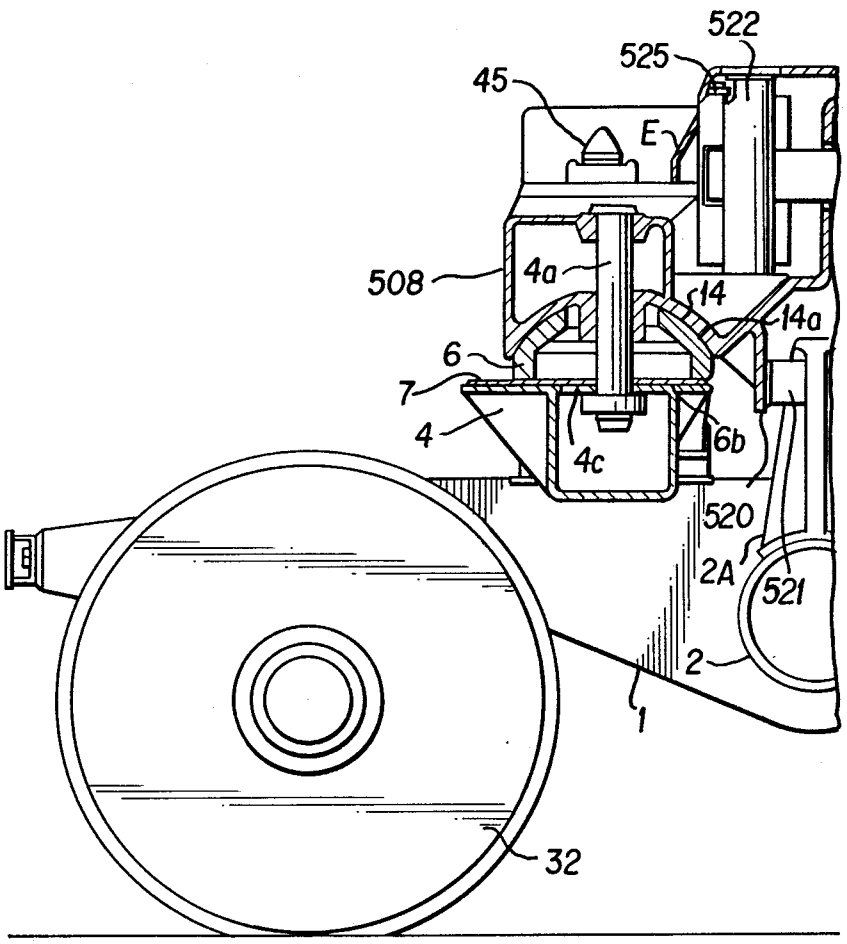
FIG. 45 is a half side view of a bogie according to the invention.

As is evident from the drawings, the bogie construction in FIGS. 45–50 is similar in many respects to that of FIGS. 4–11. More specifically, as is evident from a comparison of FIGS. 45 and 46 with FIGS. 4 and 5, the bogie construction of FIGS. 45 and 46 is virtually identical to that of FIGS. 4 and 5 with respect to the chassis, the lower bolster arrangement and the upper bolster support arrangement. In this regard, similar components are given similar reference numerals. The primary difference between the bolster construction of FIGS. 45–50 and that of 4–11 resides in the coupling of the upper bolsters. However, the construction of FIGS. 45–50 also differs from that of FIGS. 4–11 in that a center connector 2A extends from the center tube 2 to a point located between lower extensions 520 of the upper bolsters 508. A rubber rod connector 521 connects the extensions 520 of the upper bolsters 508. The rubber rod connector extends through the upper portion of the center connector 2A.

As is evident from FIGS. 45 and 46, the means connecting the upper bolsters 508 does not include a bolt. Instead, two vertically disposed pins 522 and 519, each being carried by a respective upper bolster 508, are connected by a connecting link 518.

The lower portions of the pins 522, 519 rest against portions of their respective bolsters and are thus prevented from falling down under the force of gravity.

Retraction of the pins 522, 519 is also prevented. More specifically, retraction of pin 519 is prevented by a protrusion 524 of the other bolster element. Further, retraction of the pin 522 is prevented by a washer 525 which is keyed into a side of the pin 522 and locked to the bolster by a bolt.

Figure 48:
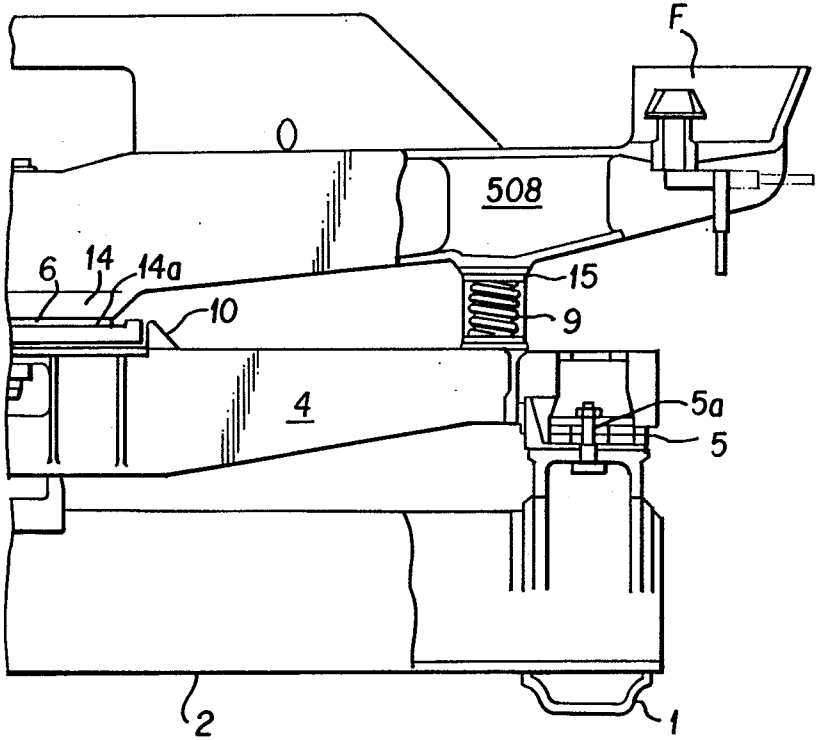
FIG. 48 is a half view of the bogie of FIGS. 45 and 46.
Figure 47:
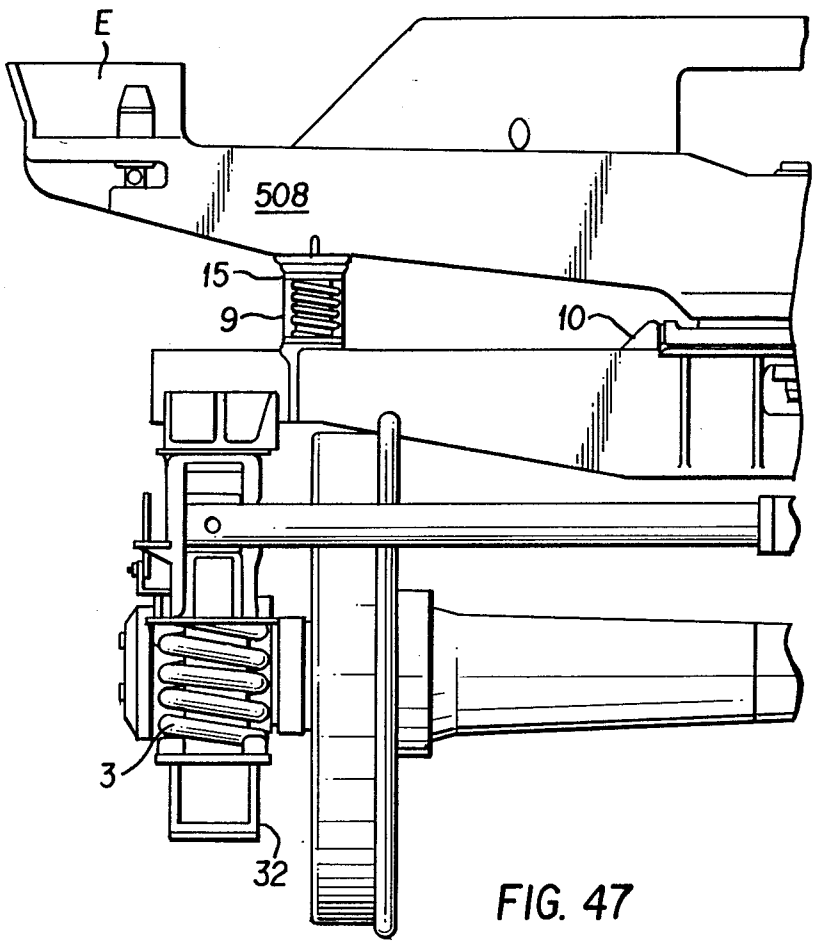
FIG. 47 is a half cross-section of the bogie of FIGS. 45 and 46.
Figure 47A:
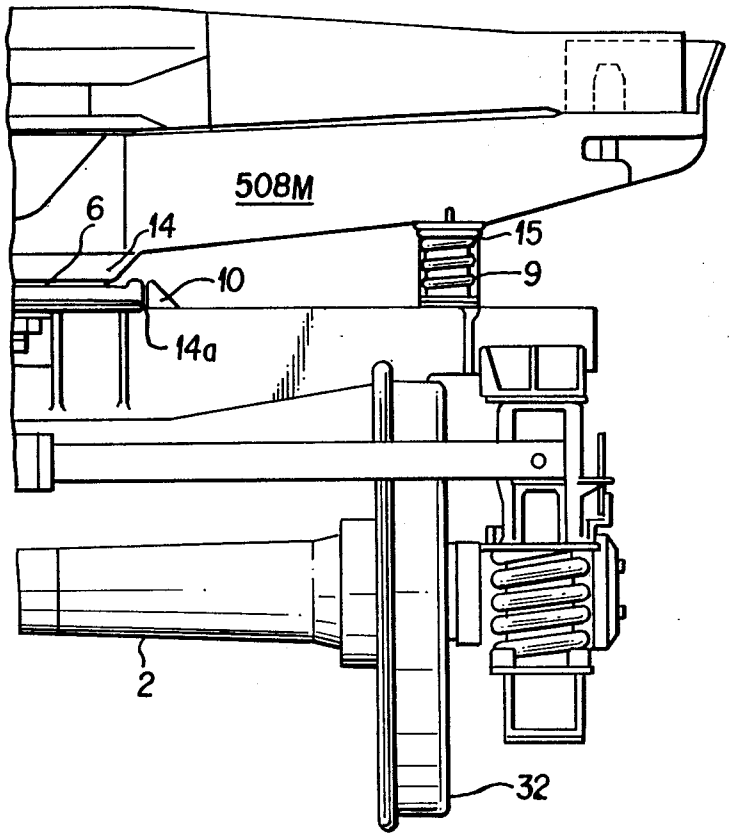
FIG. 47(A) is a half cross-section of the bogie of FIGS. 45(A) and 46(A)
Figure 48A:
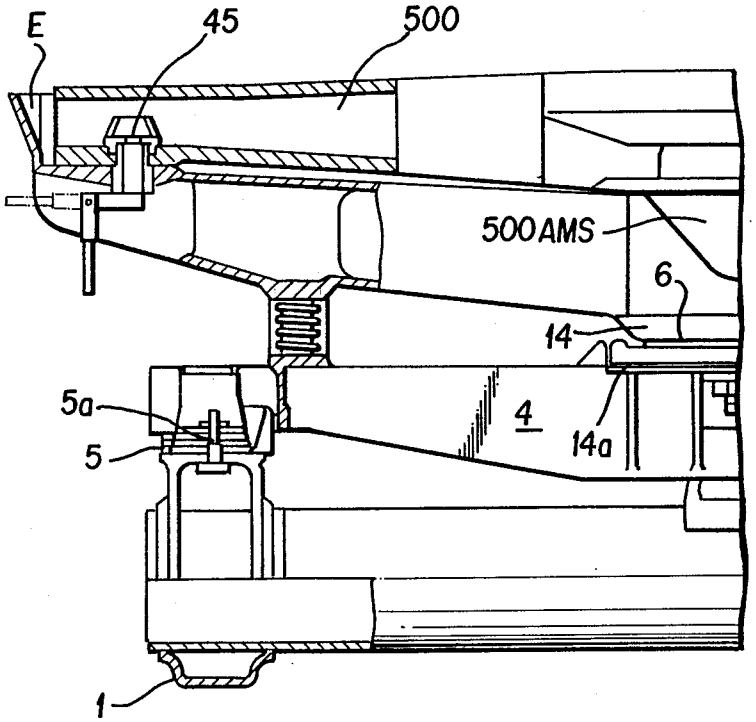
FIG. 48(A) is a half view of the bogie of FIGS. 45(A) and 46(A)

FIGS. 47 and 48 further illustrate the similarity between the alternative bogie construction of FIGS. 45–50 and the construction of FIGS. 4–11 and especially from the perspective of FIGS. 6 and 7. It should be noted that the force absorbing operation of this construction is also similar to that of the previous embodiment (FIGS. 4–11).

Figure 49:
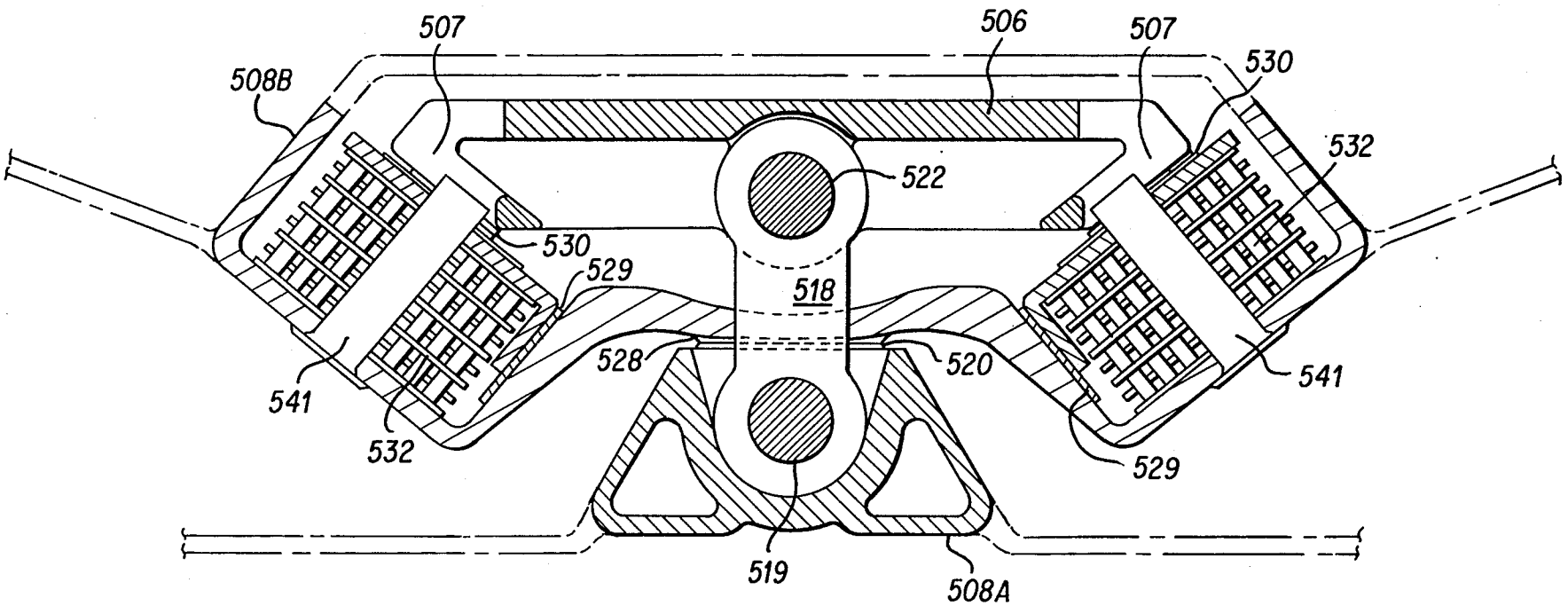
FIG. 49 is a top view of the connection between adjacent upper bolsters of the bogie of FIGS. 45 and 46.

As discussed above, the primary distinction between the embodiment of FIGS. 4–11 and the embodiment of FIGS. 45–50 resides in the connection between the upper bolster components. This connection is further illustrated in FIG. 49. As shoWn in FIG. 49, the connecting link 518 links the vertical pins 519 and 522. The connecting link 518 can pivot about either of the vertical pins 519, 522 such that the connecting link 518 pivotably connects the bolster 508A to the bolster 508B.

As further illustrated in FIG. 49, the vertical pin 522 is attached to a plate 506 which has slanted end portions or caps 507 formed at the respective end portions thereof. The caps 507 cover elastic components 532 which are supported on the second bolster 508B with the aid of support pins 541.

Fittings 528, 529 and 530 made of a material having a high friction coefficient (such as the material used to make fittings for automobile brakes) are inserted between certain moving components of the upper portion of the bogie assembly. More specifically, a fitting 528 is disposed between the contacting surfaces of the first and second bolsters 508A and 508B. Another fitting 529 is disposed between the second bolster 508B and the elastic component 532. The third fitting 530 is disposed between the cap 507 of the plate 506 and the elastic component 532. It should be noted that the elastic component 532 is preferably of the construction similar to the elastic component 11 of the embodiment of FIGS. 4–11.

An important aspect of the present invention which is not readily apparent from the drawings is the fact that the elastic components 532 are assembled in a prestressed state. The pretensioning is accomplished by designing the distance between the centers of the pins 519 and 522 in the relaxed state to be slightly greater than the distance between the centers of the pin receiving holes of the connecting rod 518. Thus, in order to couple the pins 522 via the link 518, the elastic components 532 must be slightly compressed thereby resulting in a pretensioning of these elastic components 532.

As a result of the action of the elastic components 532, the upper bolsters 508A and 508B press against each other and thus permit compression forces which occur in the train. Further, the friction created in line with the springs also serves to absorb any possible traction/compression reaction created in the train, providing the metal to metal contact (along fitting 528) of the bolster during compression. Thus, the modified upper bolster assembly of FIGS. 45–50 when employed in connection with a lower bolster and chassis assembly of the type shown in the embodiments of FIGS. 4–11 is capable of absorbing all forces acting on the bogie. Moreover, the addition of the center connector 2A and rubber spring 521 aids in absorbing, among other things, the braking force.

Figure 50:
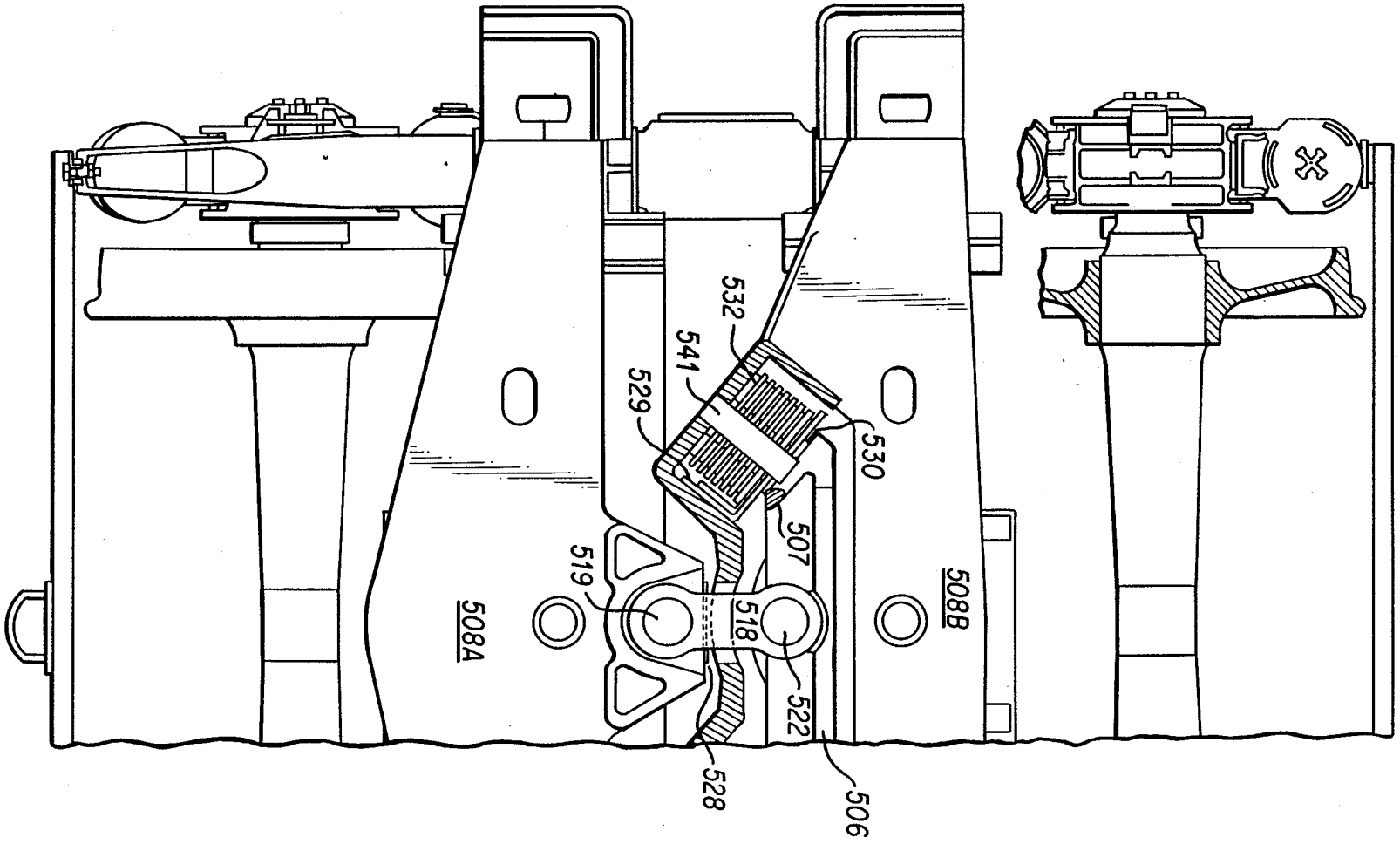
FIG. 50 is a partial top view of the bogie of FIGS. 45 and 46.
Figure 50A:
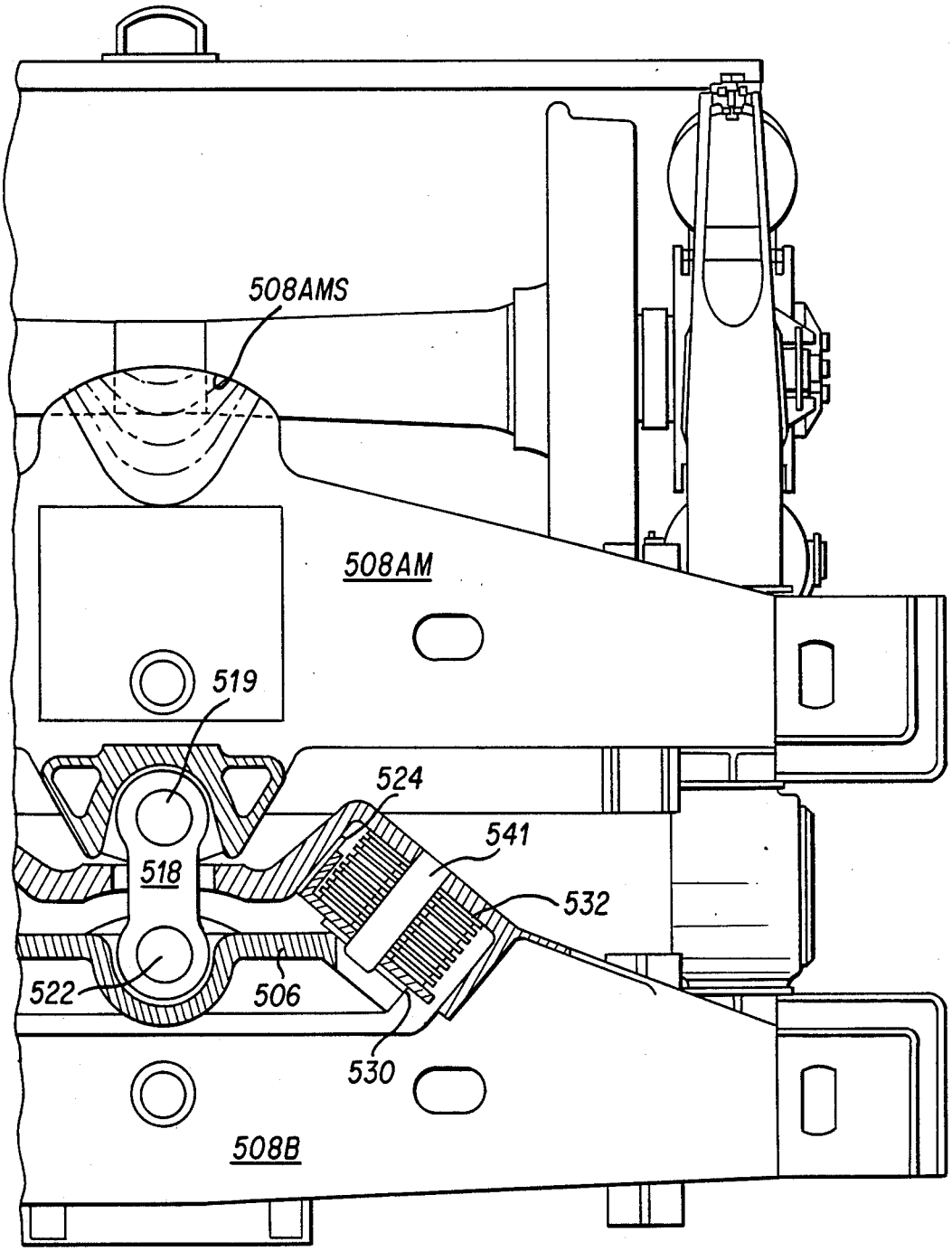
FIG. 50(A) is a partial top view of the bogie of FIGS. 45(A) and 46(A)

FIG. 50 shows, more generally, the relationship of the upper bolster assembly to the entire bogie assembly.

Figure 51:
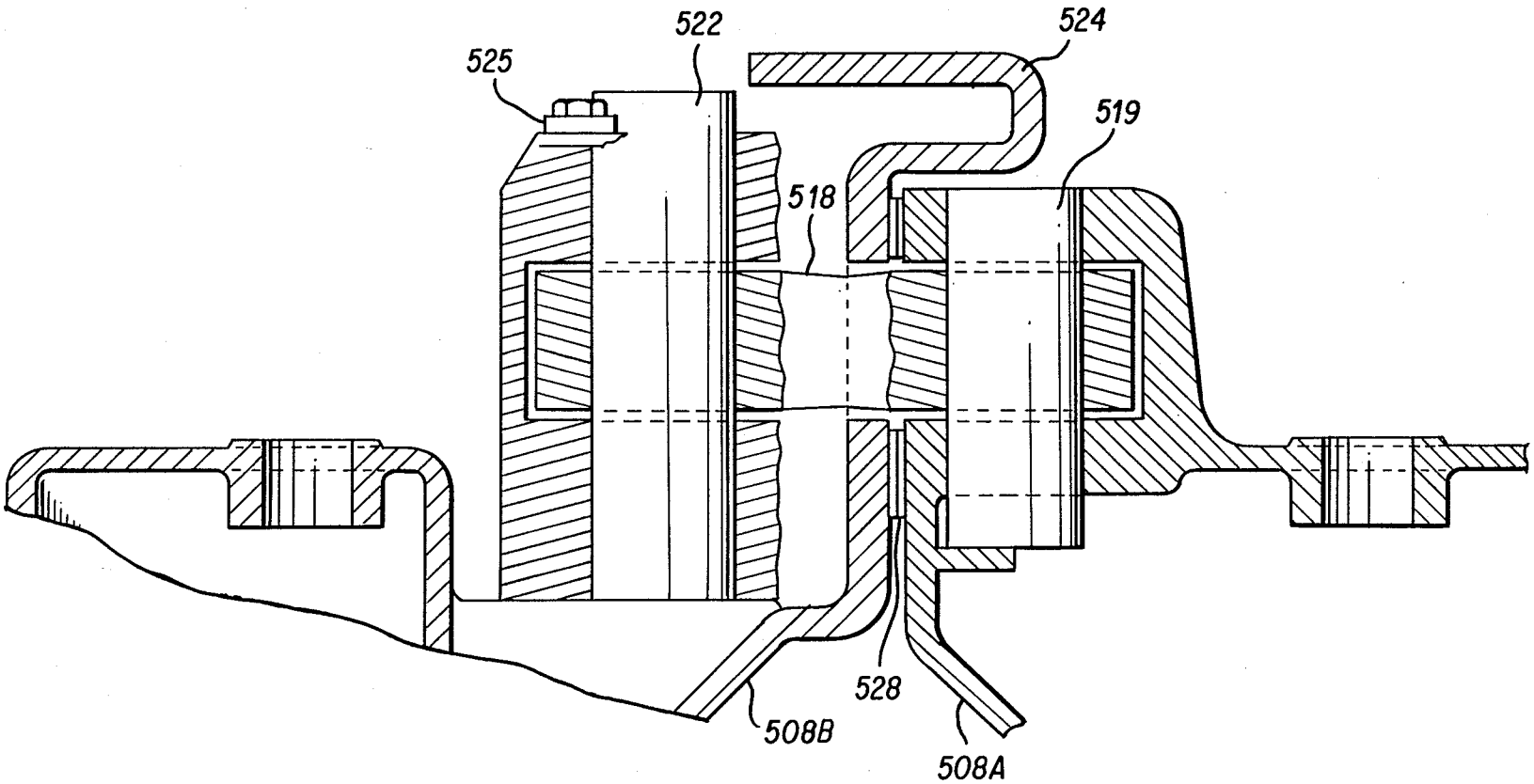
FIG. 51 is a detail of the pin connection of FIG. 49.
Figure 52C:
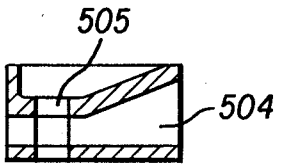
FIGS. 52(A) 52(D) are various views of an adapter bolster according to the present invention.
Figure 52D:
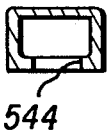
Figure 52A:
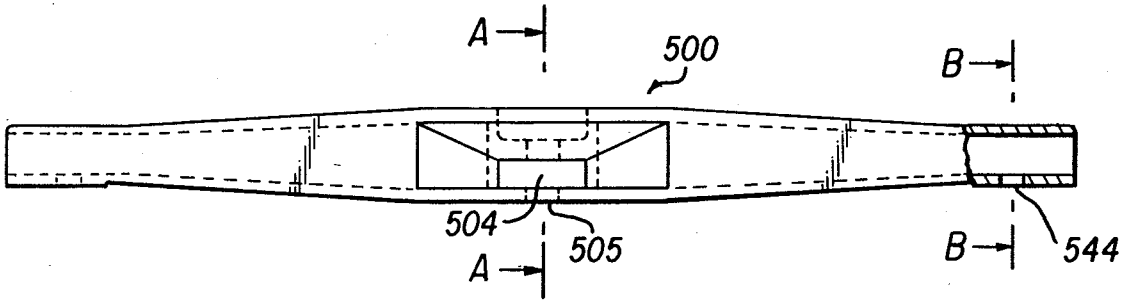
Figure 52B:
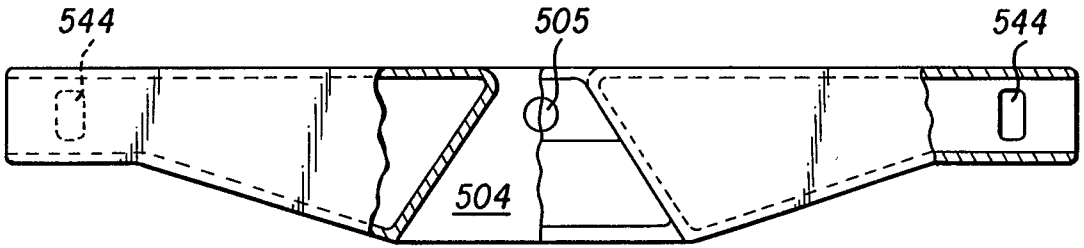

FIG. 51 shows in detail the connection between the vertical pins 522, 519 and the connecting link 518. FIG. 51 also illustrates how the extension 524 of bolster 508B inhibits retraction of the pin 519 and how the washer 525 is keyed into the pin 522 to prevent retraction of the pin 522.

As illustrated in FIGS. 45–51 it is possible to achieve the advantageous results of the embodiment of FIGS. 4–11 without the use of a connecting bolt. It should be apparent to those skilled in the art that despite the absence of the connecting bolt, the embodiment of FIGS.

45–51 absorbs the forces acting on the rail bogie in essentially the same manner as that of the embodiments of FIGS. 4–11 with the exceptions as noted above.

Figure 2:
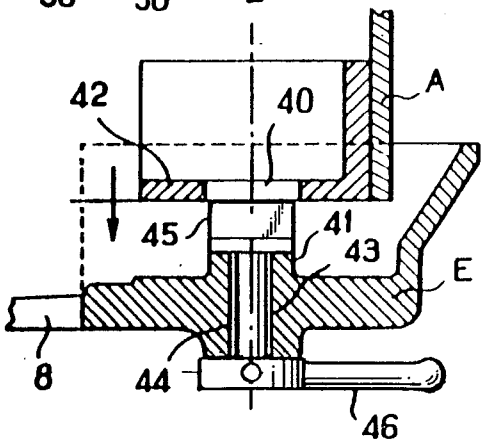
FIG. 2 is a partial cross section of a bogie support and an end of a trailer, showing a trailer being lowered into final position before locking.
Figure 3:
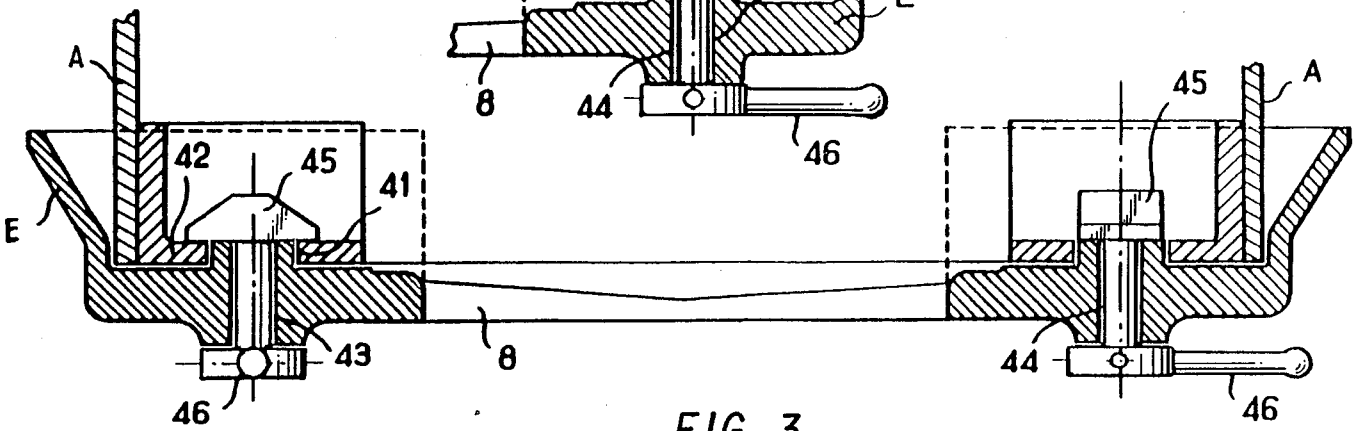
FIG. 3 is a cross section view of the unit formed by the support and the end of the trailer with the left side attaching means in the locked position but with a right side of the trailer in position but not yet locked.
Figure 13:
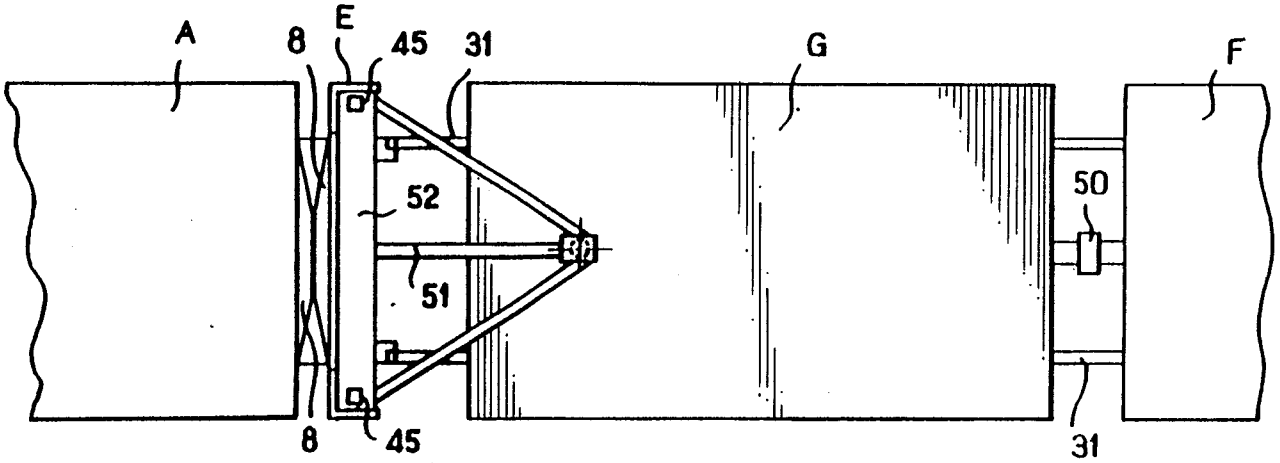
FIG. 13 is a top view of the system shown in FIG. 12.

As shown in FIGS. 2, 3 and 13, unlike conventional bogie trailer connection systems, the present invention contemplates locking means provided proximate the corners of the trailer base such that forces transmitted through the trailer are transmitted along the sides thereof. Since the sides of the trailer are inherently stronger than the center, this feature enhances the capacity of the system to withstand driving and braking forces and obviates the need for modification of the trailer such that load is transferred from the center to the sides.

In accordance with a preferred embodiment of the present invention, the lock receiving portions of the freight containers or trailer A are disposed symmetrically both longitudinally and transversly on the trailer bottom. The symmetrical disposition of the lock receiving means enables the trailer to be mounted either front forward or rear forward and ensures that the trailers can be pushed as well as pulled. Additionally, by dimensioning the spacing of the lock receiving means in conformance With published IS0 standards, the system would be capable of accepting standard IS0 containers as well as road trailers.

FIGS. 2 and 3 show a special embodiment of the device for fastening and locking the ends of the freight containers or trailers A to the bolster or cross pieces 8 of the bogie. This locking arrangement incorporates features of conventional twist lock locking devices.

Each cross piece or bolster 8 is provided with two end portions E suitable to accommodate the opposite sides of a trailer A. As shown in FIG. 3, the end portions E each include a ramp loading guide in the form of an outwardly extending flange which is adapted to adjust the ends of the trailers.

The locking means comprise an opening 40 at each end of a trailer A that can engage on a boss 41 on the end support portion E in the form of a corresponding block, with the height of the boss 41 corresponding substantially to the thickness of the wall 42 in which the openings 40 are placed. As noted above, the openings are preferably symmetrically disposed on the trailer bottom. Each boss 41 includes a bore or hole 43 which passes through the bolster end portion E, in which a shaft 44 is engaged, one end of which holds a locking component 45 and the other end, an operating handle 46. The locking component 45 can engage in the opening 40. The dimensions of this component 45 and the opening 40 are greater in one direction than in another direction traversing the former, so that the locking component 45 can cover the opening 40 when it is turned in a position such that its long dimension is directed along the small dimension of the opening 40, as shown on the left in FIG. 3.

Although the height of the boss 41 and the thickness of the trailer wall 42 are dimensioned to avoid play, some play is inevitable due to manufacturing tolerances and variations among the many trailers which will become associated with any one locking device over the life of the locking device. Such play results in premature wear as a result of movement between the trailer A and the bolster end portions E.

Figure 24:
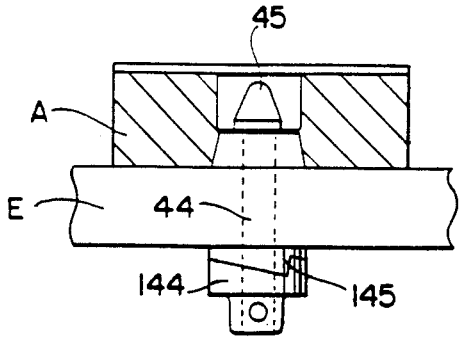
FIG. 24 is a cross section of a modified twist lock of the present invention.
Figure 25:
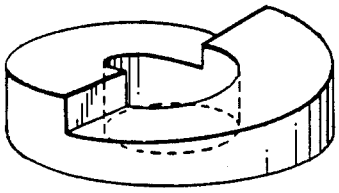
FIG. 25 is a perspective view of a cam used in the lock device of FIG. 24.

FIGS. 24 and 25 shows a modification of the locking device of FIGS. 2 and 3 for eliminating play between the trailer A and bolster end portion E. Specifically, the twist lock is modified to include a pair of ring shaped face cams 144 and 145. The first cam 144 is rotationally secured to shaft 44 and the second cam 145 is secured to or integral with the bolster end portion E. FIG. 25 shows the shape of the cams 144 and 145.

In operation, as the locking component 45 and shaft 44 are pivoted 90° to the locking position, the first cam 44 is rotated with respect to the second cam 145 such that the locking component 45 is pulled down tightly against the trailer to clamp the trailer to the bolster and thereby eliminate play.

FIGS. 41–44 illustrate an unique operating handle in accordance with a further aspect of the present invention. The operating handle includes a U-shaped member 462 keyed or otherwise rotatably connected to the shaft 44 of the locking device at 464. The handle further includes a handle component 460 which is pivotably mounted within the U-shaped member 462 via pin means 461.

Figure 41:
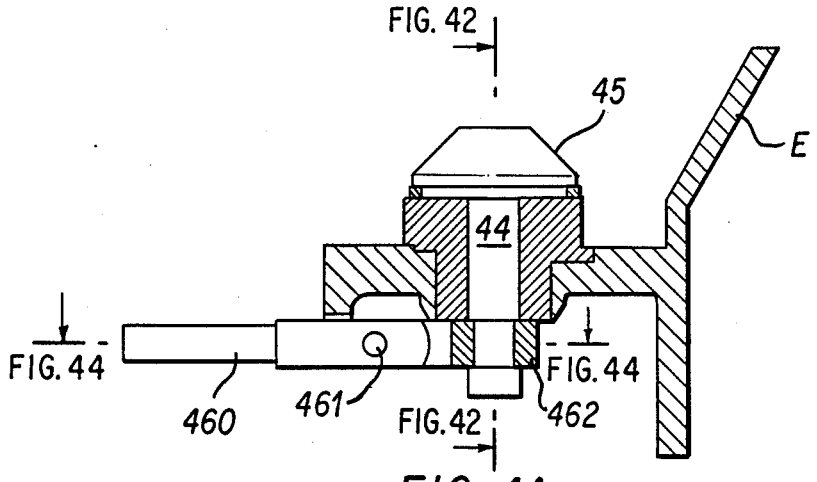
FIG. 41 is a cross-section of an twist-lock operating handle assembly.
Figure 44:
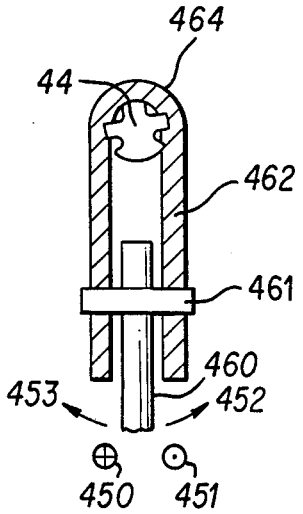
FIG. 44 is a detail of a portion of the operating handle assembly.

In the operating position shown in FIGS. 41 and 44, the longitudinal axis of the handle component 460 is aligned with the longitudinal axis of the U-shaped component 462 such that the handle component 460 may be pivoted in the direction of arrows 453 or 452 to cause rotation of the shaft 44 and the locking component 45 of the twist lock. However, when the handle component 460 is pivoted with respect to the U-shaped member 462 into the locking position illustrated in FIGS. 42 and 43, the abutments 465 extending from the end portion of the bolster E prevent movement of the handle component 460 in the direction of the arrows 453 and 452. Consequently, the U-shaped member 462, the shaft 44 and the locking component 45 are locked against rotation.

Figure 42:
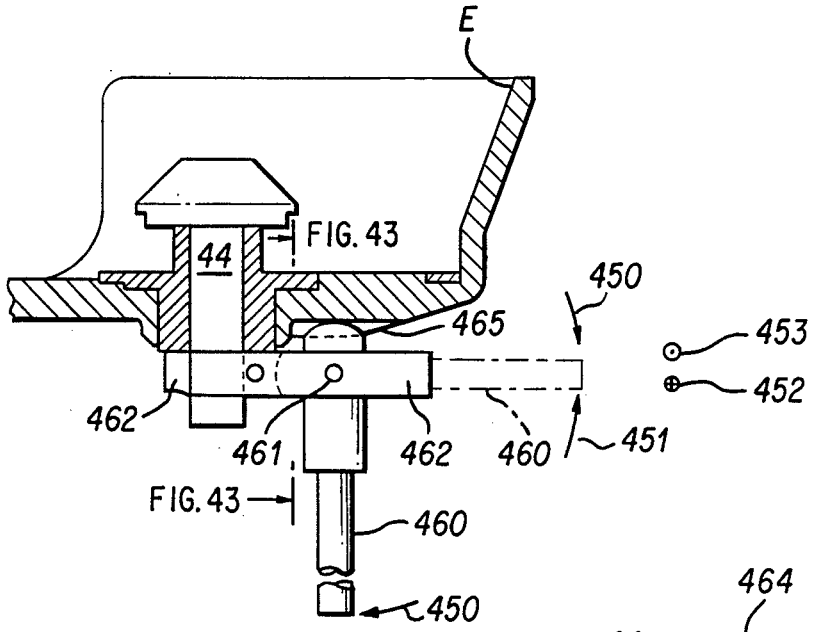
FIG. 42 is another cross-section of the operating handle assembly.
Figure 43:
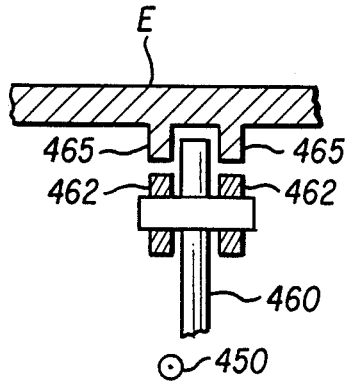
FIG. 43 is a detail of a portion of the operating handle assembly.

The pivoting of the handle component 460 is best illustrated in FIG. 42 wherein the handle is shown in its locked position in solid and in its operating position in phantom. The arrows 450 and 451 illustrate the direction of pivoting of the handle 460 with respect to the U-shaped member 462 to move the handle from the operating position to the locked position.

The operating handle assembly illustrated in FIGS. 41–44 provides a simple yet reliable means for selectively rotating the shaft 44 and locking head 45 of a twist lock or locking these members against rotation.

In accordance with a further aspect of the present invention, an integrated locking device may be substituted for conventional twist lock locking means described above. The construction and operation of the integrated locking device will be described hereinafter with reference to FIGS. 19–23 below.

Figure 19:
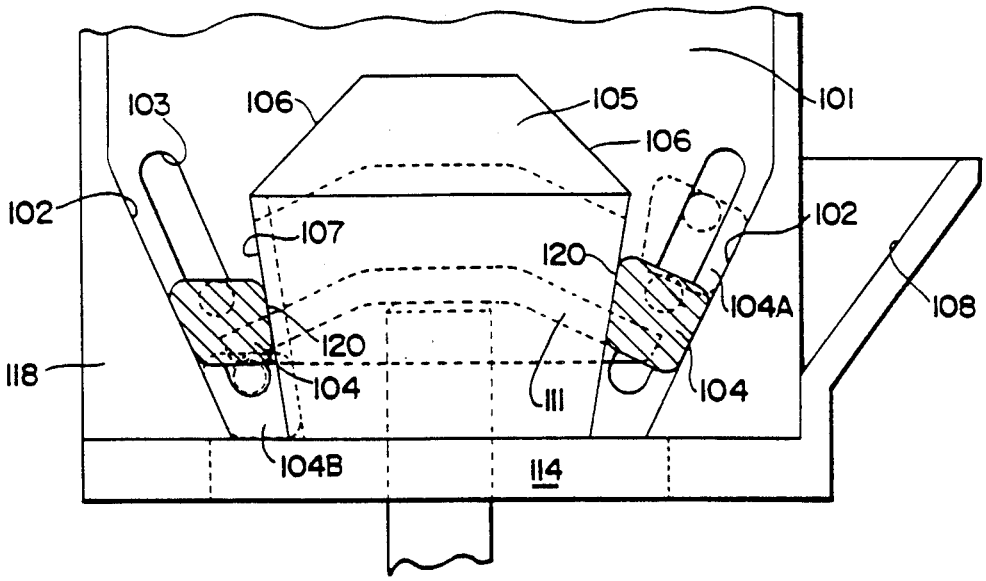
FIG. 19 is a combination cross-section/view of a locking device of the present invention along line C—C of FIG. 20.

As shown in FIG. 19, each integrated locking device includes a rectangular parallelpiped female member 101; a male member or fastening plug 105; a pair of movable masses 104; a lifting lever 111; and a lever actuating button 114.

Each rectangular parallelpiped female member includes four interior side walls. A first pair of opposed side walls comprise sloped guide surfaces 102. The second pair of opposed side walls includes four movable mass guide slots 103, (two slots on each one of the second pair of side walls).

Each guide slot 103 has a longitudinal axis which is parallel to the plane of one of the respective sloped guide surfaces 102 and also parallel to one other guide slot 103. Thus, the guide slots are provided in opposed pairs with each pair being parallel to a respective one of said two sloped side walls.

Figure 20:
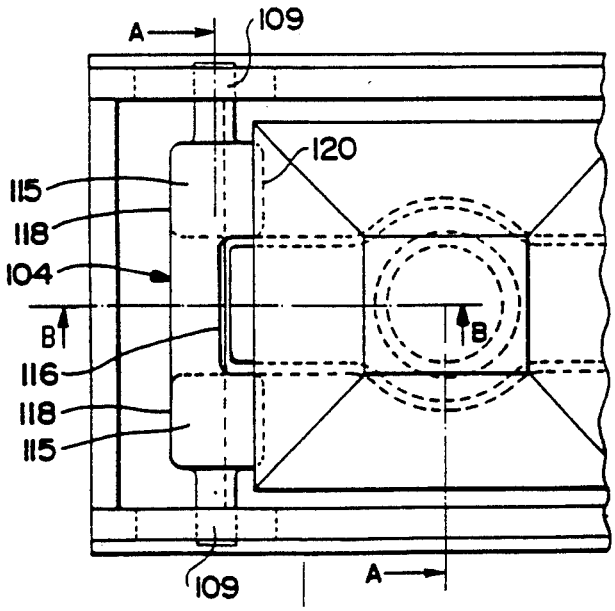
FIG. 20 is a top view of a locking device of the present invention.

FIG. 20 shows one of the pair of movable masses 104. Each movable mass 104 includes a wedge portion 115, a pair of cylindrical projections 109 extending from opposed ends of the Wedge portion 115 and a central lever receiving groove 116. The cylindrical projections are received in an opposed pair of movable mass guide slots such that the guide slots guide the movable mass for movement in a direction parallel to the sloping side wall (see FIG. 19). As is evident from the drawings, the wedge portion 115 includes a face 118 which is in planar contact with the sloping side wall. The wedge portion 115 also includes a face 120 in planar contact with the sloping side wall 107 of the fastening plug 105.

With reference to FIG. 19, the fastening plug 105 includes an upper portion having sloping side walls 106 and a lower portion having sloping side walls 107. The side walls 107 slope at an angle which allows planar contact with the face 120 of the movable mass means. Further, as is evident from FIG. 19, the sloping side walls 107 of the plug 105 are not parallel to the sloping side walls 102 of the parallelpiped female member 101. Hence, the wedging portion 115 of the movable masses 104 are adapted to wedge between the sloping side walls 102 and 107 either under the influence of gravity (when oriented as shown in FIG. 19) or as a result of spring biasing by a spring (not shown).

Figure 21:
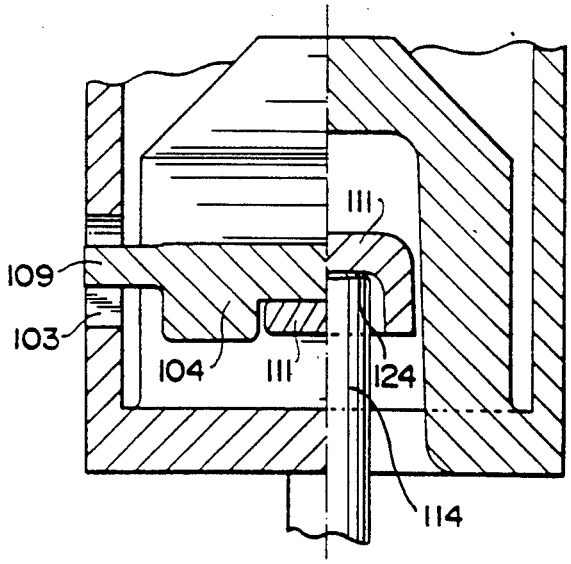
FIG. 21 is a cross section along line A—A of FIG. 20.
Figure 22:
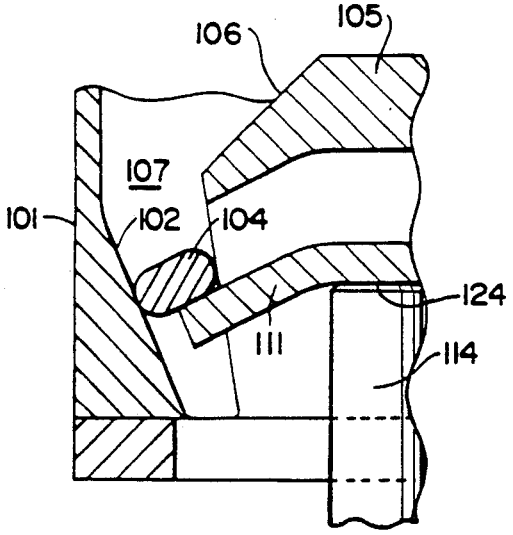
FIG. 22 is a cross section along line B—B of FIG. 20.

As shown in FIGS. 22 and 21 and in phantom in FIG. 19, the side of the fastening plug 105 is drilled out so as to allow a lever 111 to pass through and be guided. The lever extends beyond the sloping side walls 107 and is adapted to be received in the central lever receiving grooves 116 of the movable masses 104. Once received in the grooves 116, movement of the level 111 vertically as illustrated in FIG. 22 results in movement of the movable masses 104 which are engaged with the lever 111.

A lever actuating button 114 having an end surface 124 in contact with a medial portion of lever 111 controls movement of lever 111 and ergo movement of the movable masses 104.

In use, the loCking device is typically oriented as shown in FIGS. 19, 21, and 22. In this position, gravity pulls the movable masses toward the lowest position permitted by slots 103. Thus the movable masses will assume this lowest position unless they are either lifted against the force of gravity by lever 111 or wedged between the side walls 107 of the fastening plug 105 and the side walls 102 of the female member 101. As previously noted, a spring (not shown) may be used to bias the movable masses 104 downwardly to assist the gravitational pull on masses 104.

At this point it should be noted that the parallelpiped female member 101 is preferable secured to or integral with the trailer A and the fastening plug 105 is preferably secured to or integral with the bolster end portion E which supports the trailer A on the bogies. Preferably, the components which are secured to or integral with the trailer are symmetrically disposed on the trailer bottom.

When the trailer A is set over the bogie, the movable masses 104 rest on the slOping walls 106 of the fastening plug 105 and are thus lifted upward. During the downward movement onto the bolster, the trailer A is initially guided by contact with either the bolster rim 108 or the sloping side walls 10 of the fastening plug 105. The descent then continues vertically as soon as the contact between the parallelpiped female member 101 and the side wall 106 or rim 108 is broken. During the downward movement, the movable masses 104 are moved outwardly by contact with the fastening plug 105. As soon as the movable masses 104 are out of contact with the fastening plug 105, they fill the open space between the sloping side walls 107 of the fastening plug 105 and the sloping side walls 102 of the parallelpiped female member 101 and as a result of gravity and/or spring force, they fill the open space between these side walls and wedge between the side walls as shown in FIG. 19.

Since the two movable masses 104 are independently movable they can assume different positions as shown in phantom at **104*a* and 104*b* in FIG. 19. This ability to assume different positions allows the movable masses to automatically compensate for positioning tolerances with respect to the relative positions of the parallelpiped female member 101 which is secured to or integral with the container/trailer A and the fastening plug 105 which is secured to integral with the bolster E. This is particularly important given the fact that when used as presently contemplated, trailer A will be consistently associated with a different set of bogies and the fastening plug 105** must be received in the parallelpiped female members throughout its use.

It should be apparent that when as, shown in FIG. 19, the movable masses 104 are wedged between the sloped surface 107 of the fastening plug 105 and the sloped surface 102 of the parallelpiped female member 101, the different slopes of side walls 102 and 107 and their planar contact with the movable masses 104 prevent any lifting or shifting of the parallelpiped female member 101 (and hence the trailer A) with respect to the fastening plug 106 (and hence the bolster 8 at its end portion E). Thus, the trailer A is securely locked to the bolster 8 at its end portion E.

As with the twist lock means discussed above, it is contemplated that the trailer A be locked to the bolster end portions E at each corner of the trailer A.

Figure 23:
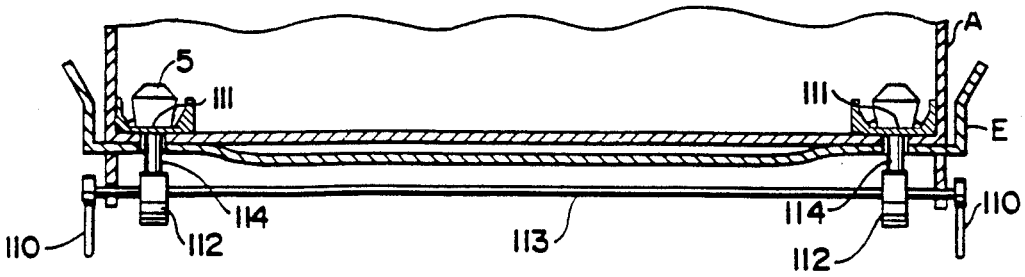
FIG. 23 is a combination view/section of a means for operating the locking devices of FIGS. 19—22.

As previously noted, a lifting lever 111 and lever actuating button 114 are provided in the fastening plug 105 for selectively lifting the movable masses 104 against the force of gravity and/or the spring force so as to break the planar contact between the movable surface 120 and the sloping side surface 107 of the fastening plug 105 thereby unlocking the locking device. FIG. 23 illustrates a control rod arrangement for reciprocating the actuating button 114 so as actuate the lever 111 to selectively lift the movable masses 104.

The control rod arrangement includes a control rod 113 extending across and beyond the width of the trailer A and below the bolster end portion E. As shown in FIG. 23, the control rod 113 can be journaled in an extension of the bolster end portion E. A control handle 110 is exposed at each end of the control rod 113. Additionally, an eccentric cam 112 is mounted under and in contact with the lever actuating button 114 of each locking device to be controlled. The eccentric cams 112 are rotatably secured to the control rod 113 such that rotation of the control rod causes rotation of the eccentric cams 112.

Due to the eccentricity of the cams 112, rotation of the cams results in reciprocation of the lever actuating buttons 114 which are in contact therewith. As previously noted, vertical movement of the lever actuating buttons 114 causes lifting and releasing of the movable masses 104 via the lever 111. The handles 110 provide a moment arm for rotating the control rod 113.

As is evident from FIG. 23, the control rod arrangement described above permits simultaneous control of two or more locking devices. In particular, in the position shown in FIG. 23, the smaller radius portion of the cam 112 is in contact with the lever actuating button 114 such that the lever 111 is in a rest position and the movable masses are free to move under the force of gravity. However, when one of the handles 110 is rotated 180° the lever actuating button 114 is gradually moved upward so as to actuate the lever 111 and lift the movable masses 104 thereby unlocking the locking device.

As described above, the use of a control rod arrangement of the type shown in FIG. 23 enables simultaneous control of two or more locking devices. However, should individual control of the locking devices be desired, it can be accomplished by simply providing a separate control rod and cam for each locking device or providing some other means of actuating the lever 111.

A final aspect of the integrated locking device of the present invention is best understood with reference to FIG. 21. As shown in FIG. 21, one of the cylindrical projections 109 of each of the movable masses 104 extends through the guide slot 103 to the outside edge of the parallelpiped female member. If this outside edge is also the outside edge of the trailer A, then the end face of the cylindrical projection 109 is visible from outside the trailer A. By painting the end face of the cylindrical projection 109 with a distinguishable color, and marking the area of the trailer proximate the slot with markings to indicate the proper location of the movable mass in a locked position, an inspector standing on a loading platform will be able to quickly detect any failure of the locking system. Accordingly, the integrated locking device offers an advantage in that it may be easily constructed for simple visual inspection to ensure proper operation.

Among the advantages of the integrated lock system over conventional twist lock systems are the secure no-play fastening which is obtainable through the use of the integrated locking device, the elimination of both vertical and longitudinal movement between the members and the ability to use a single control member to unlock two or more locking devices from either side of the train.

All of the aforementioned locking devices share an advantageous feature. Specifically, the locking devices disclosed herein all permit vertical loading of the freight container or trailer onto the bogies. In contrast, conventional intermodal systems require some horizontal or longitudinal movement of the trailer in order to couple the trailer to the bogie.

Vertical loading is particularly advantageous when it is desired to, for example, remove a centrally loaded located freight container or trailer from a long string of trailers or freight containers. More specifically, because no longitudinal or horizontal displacement of the containers to be loaded/unloaded onto or off a bogie is required, any one of the string of trailers or containers may be removed from its supporting bogies without disturbing the remaining trailers or containers in the string. In contrast, in conventional systems which require longitudinal displacement of the trailers to couple them to the bogies, the trailers must be sequentially coupled or decoupled to the bogies to form the string of trailers. Thus, in an instance where it is desired to remove a centrally located trailer from the string an entire series of trailers must be displaced until the desired container is reached and the string must be reassembled. Thus, although the ability to decouple any of the string of trailers, it is also disturbing the other trailers which results from the vertical loading feature is particularly advantageous when removing a centrally located from a long string of trailers, it is also advantageous in any situation where it is desired to decouple or load a trailer at any point other than ends of the string o trailers.

It should be evident that since in the present invention, it is the trailers alone which couple adjacent bogies, the removal of a centrally located trailer from the string of trailers could present a problem. Specifically, once the trailer or container is decoupled from the bogies which is supported these bogies are no longer connected to one another such that the string of trailers is broken into two separate strings. In ordinary use, this potential problem will not arise since it is contemplated that when a container or trailer is removed it will typically be replaced with another container or trailer such that the string of trailers remains intact. However, if it is desired to remove a trailer or container without replacing it, some means must be provided for keeping the string of trailers intact.

Figure 39A:
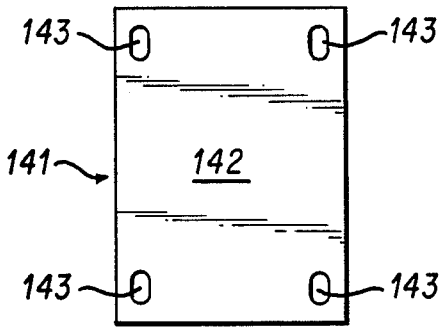
FIG. 39(A) is a top view of a coupling plate of 17 the present invention.
Figure 39B:
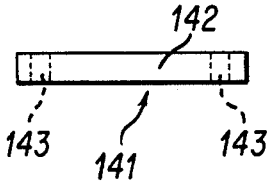
FIG. 39(B) is an end view of the coupling plate.

One possible means of keeping the string of trailers intact is a steel coupling plate such as that shown in FIG. 39. In its simplest form, the coupling plate 141 consists of a rectangular metal slab 142 having a series of symmetrically disposed openings 143 therein. As is evident from FIG. 39, the openings 143 are elongate so as to receive the locking component 45 of a twist lock means. Of course, an alternative lock receiving means such as the female parallel piped member 101 of the integrated locking device discussed above may be symmetrically disposed on the steel plate.

Figure 40:
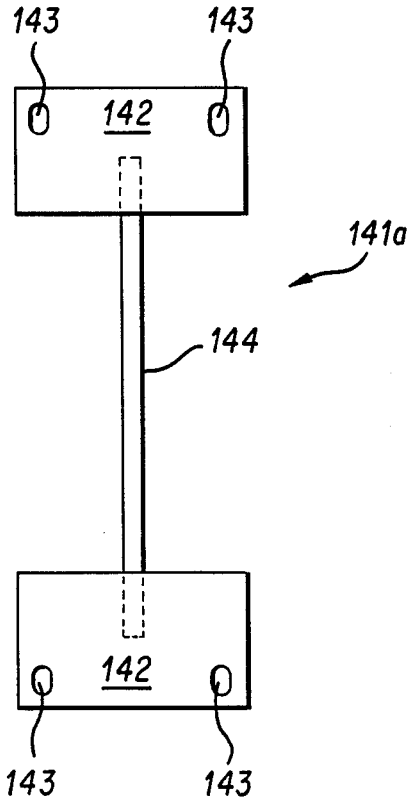
FIG. 40 is a top view of a modified coupling plate.

As illustrated in FIG. 39, the steel connector plate 141 is ideally quite short so as to reduce the weight of the member. However, if a longer connector is advantageous, (such as when it is desired that the connecting plate 141 be the same length as a freight container or trailer) it may be advantageous to employ a split plate connector of the type shown in FIG. 40.

In the split plate connector 141 two rectangular steel plates 142 are spaced apart and connected by a connecting member 144. As with the previous connector, lock receiving means 143 are symmetrically disposed on the surface of the two split plates 142.

It should be evident that the provision of a simple connecting element obviates any disadvantage which may result from the decoupling of a centrally located container or trailer from a string of trailers without disturbing the other trailers in the string as is permitted by the vertical loading and unloading feature of the present invention.

The advantageous vertical loading contemplated in accordance with the present system is further aided by the novel trailer construction of the present invention in which, unlike conventional rail trailers, there is nothing under the trailer which precludes lifting the trailer from below.

It should be evident that the combination of the ability of the trailers to be vertically loaded and unloaded onto the bogies and the fact that there is nothing to preclude lifting the trailers from below (as in a piggyback type arrangement) yields significant advantages over conventional systems.

The railroad and road transportation system according to the invention also includes (see FIGS. 12 and 13) an adapter car G to achieve the coupling of the string of trailers A to a locomotive or a conventional rail car F. The adapter car G has, at one of its ends, a conventional railroad coupler 50 connected to the locomotive or conventional rail car F and, at its other end, coupling means adapted to achieve a connection with the upper cross piece or bolster 8 of the bogie, which is normally provided to accommodate one of the ends of a trailer A.

The coupling means includes a railroad coupler 50 connected on the one hand to the adapter car G and on the other hand to a cross piece 52 designed to be locked to the cross piece or bolster 8 of the bogie using locking means 45 identical to those normally provided to lock the end of a trailer A to a bogie cross piece or bolster 8.

Figure 12:
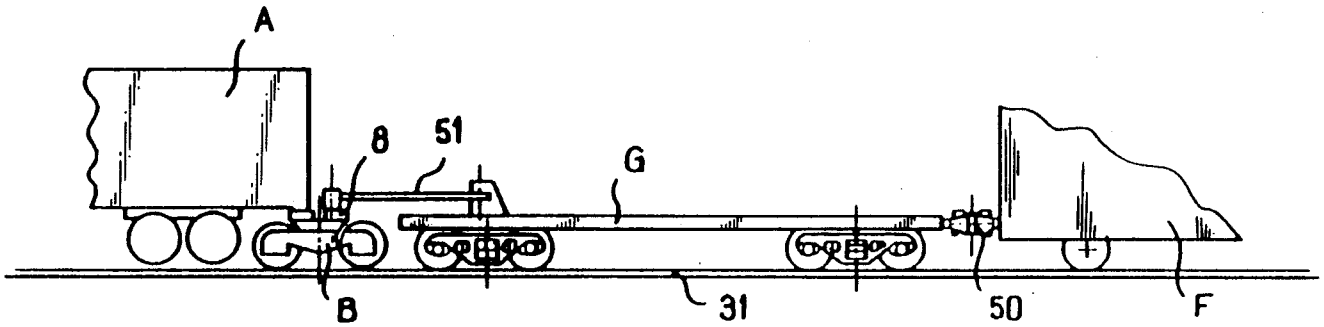
FIG. 12 is a side view showing a special car used as a connection between a conventional rail car or the locomotive and a bogie according to the invention.

As is evident from FIG. 12, the bolster to which the cross piece is locked is substantially higher in the vertical direction than the coupler 50, i.e., is elevated with respect to the coupler 50. Because of this elevation or height difference a moment is generated. To lessen the effect of this moment, the car G must be either elongated as shown in FIGS. 12 and 13 or exceptionally massive.

Figure 12A:
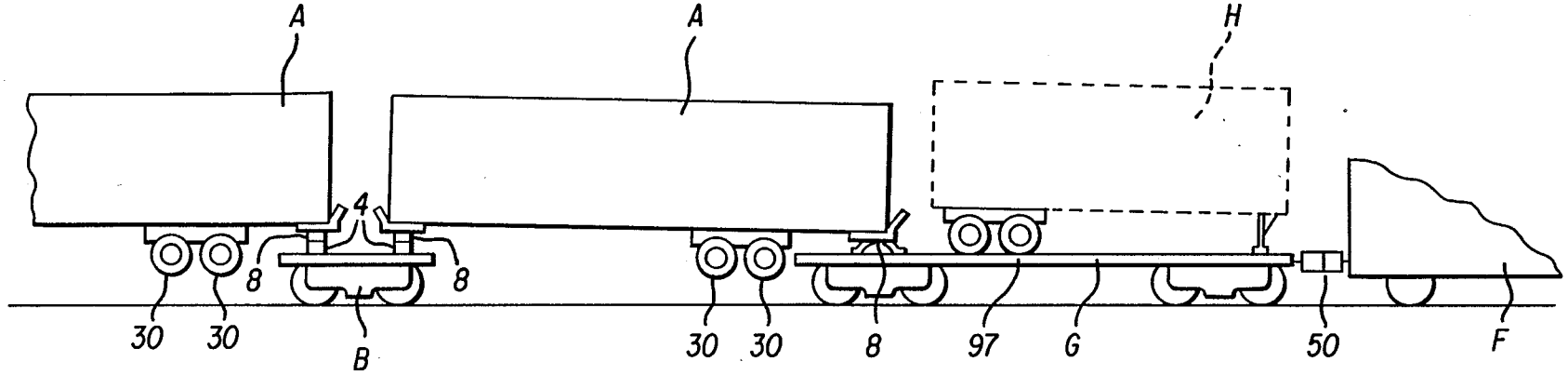
FIG. 12(a) is a side view of an alternative adapter car construction.

An alternative adapter car construction is illustrated in FIG. 12A. Like the adapter car of FIG. 12, the adapter car G of FIG. 12A includes one end (the right end in FIG. 12A) having a conventional drawbar or railroad coupler 50 adapted for connection to a locomotive or conventional car or trailer F. However, unlike the adapter car of FIG. 12, the other end (the left end in FIG. 12A) does not include a conventional rail coupler. Instead, the adapter car G includes a bolster 8 adapted to support a trailer end.

The bolster 8 is essentially mounted between the pairs of wheels which comprise the left set of wheels of the adapter car. Thus, the trailer A is directly supported on the adapter car rather than on a bogie having a coupler which is connectible to an adapter car.

Accordingly, it is not necessary to have two closely spaced rail trucks or bogies as in FIG. 12. Furthermore, since a longer flat bed may be used on the adapter car, the flat bed 97 may be put to use such as, for example, to support an additional freight container H in a piggyback fashion as illustrated in phantom in FIG. 12A. While the freight container H illustrated in phantom in FIG. 12A is shown in a shorter length version than the freight containers A, if the flat bed 97 of the adapter car G were extended, freight containers of the size of the trailers A could be supported on the flat bed 97 of the adapter car G. Moreover, a freight container could be constructed on the available flat bed 97 of the adapter car.

While the bolsters support B is only schematically represented in FIG. 12A, it should be recognized that the particular construction of the spherical bearing could be similar to any of the embodiments disclosed herein. The primary requirement of the bolsters support being the capability of absorbing the stresses and twisting moments to which rail cars are subjected. It also should be noted that the bolsters are preferably located between the wheels of the left hand set of wheels of the adapter car G.

The adapter car shown in FIG. 12A offers several advantages over the adapter car of FIG. 12. For instance, it permits a simpler construction in which there is no need for two closely spaced rail trucks as in FIG. 12. Moreover, the construction allows a longer flat bed 97 to be used which may be used to support a freight container on the flat bed.

Finally, the adapter car of FIG. 12A simplifies the entire transportation system by obviating the need for specially constructed bogies and/or bogie connectors. In particular, according to the embodiment of FIG. 12A, a single specially constructed adapter car G takes the place of the adapter car G and specially constructed bogie or bogie connector of the embodiment of FIG. 12. Thus, the transportation system can function without the need for specially constructed bogies or connectors which permit the bogies to accept a trailer at one end and a drawbar at the other end.

Figure 56:
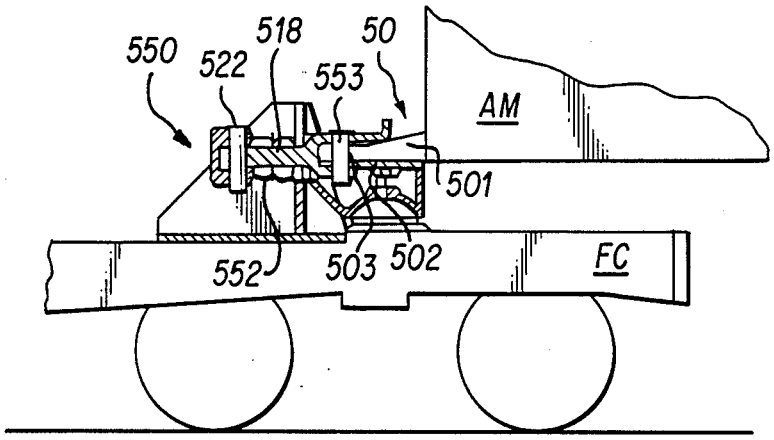
FIG. 56 is a side view of the rear end of a flat car adapter according to the present invention.
Figure 57:
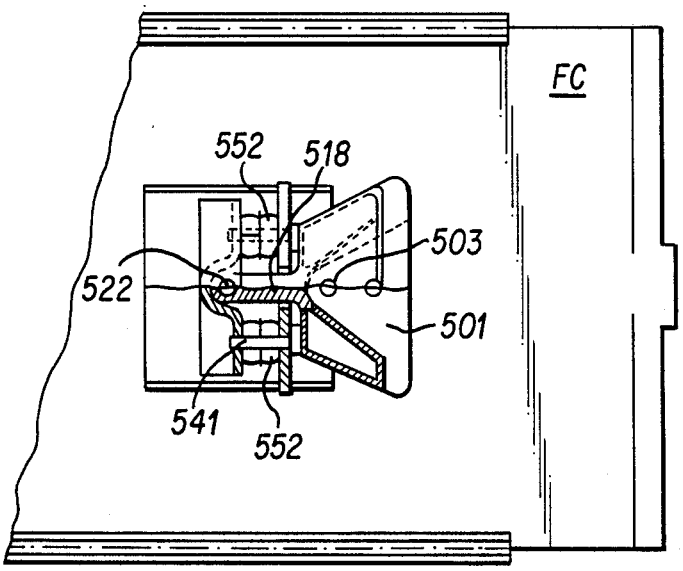
FIG. 57 is a top view of the flat car adapter of FIG. 56.
Figure 58:
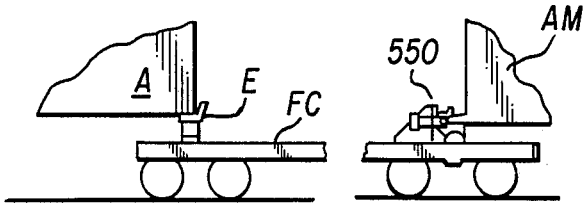
FIG. 58 is a schematic side view showing the flat car adapter shown in FIGS. 56 and 57 connecting an intermodal trailer of the present invention to a conventional bi-modal trailer.
Figure 59:
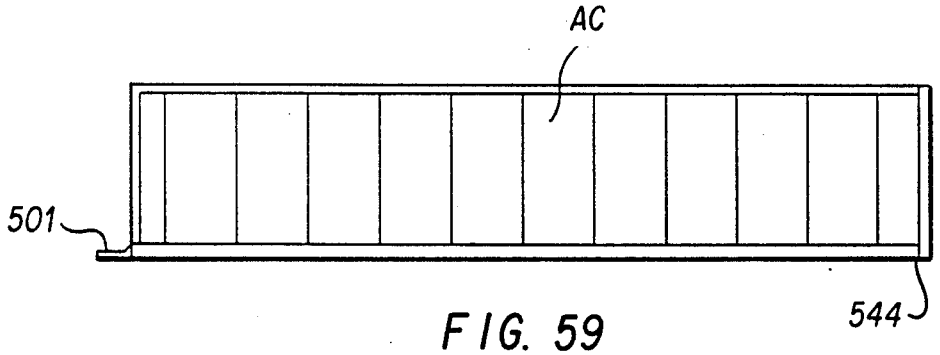
FIG. 59 is a side view of an adapter trailer according to the present invention.

FIGS. 56-58 illustrate the embodiment which includes a bolster 8 at one end and a structure 550 for receiving a drawbar arrangement 50 at the other end.

FIG. 56 shows a side view of the drawbar support structure 550 and FIG. 57 shows a top view thereof. The support structure 550 is similar to a portion of the bogie constructions described herein and the same reference numeral is, in some instances, used to refer to similar components. The support structure 550 includes a connecting link 518 which includes a female portion 502 for receiving the drawbar 501 of the conventional intermodal trailer AM. A pin 553 o the like extending in drawbar opening 503 pivotably secures the drawbar to the link 518. Of course, the support structure could also be designed to receive any conventional drawbar. The link 518 is pivotable mounted about a pin 522 and springs 552 supported by support bars 541 are interposed between plates of the support structure to deform when the link 518 pivots such the force is absorbed.

As with the bogie arrangements described herein the support structure 550 is mounted on the flat car FC so as to absorb forces in any direction. Although only one support structure is illustrated, it should be recognized that any of the bogie constructions described herein could be adapted for use as an adapter car support structure in a similar fashion. The primary requirements of any such support structure system are a pivoting connecting link which can receive the coupling element (e.g. drawbar) of the conventional trailer and an elastic support structure for absorbing movements in any direction.

Figure 53:
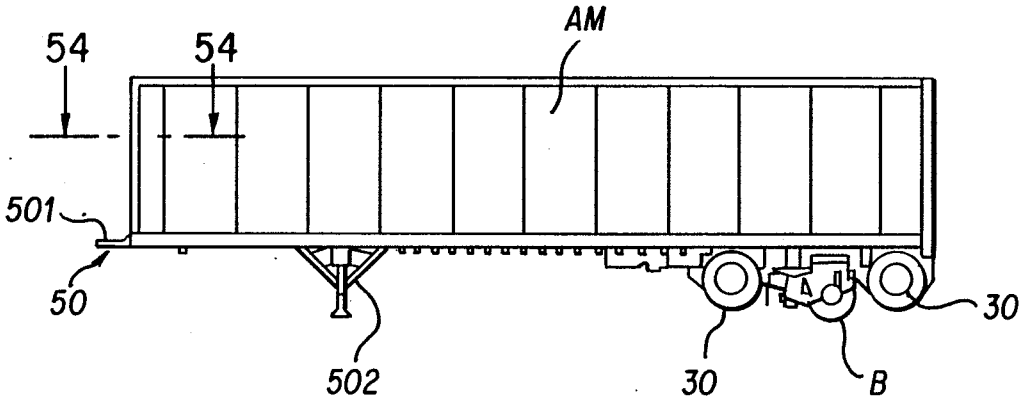
FIG. 53 PRIOR ART
FIG. 53 is a side view of prior art bi-modal trailer construction which is compatible with the intermodal system of the present invention.
Figure 54:
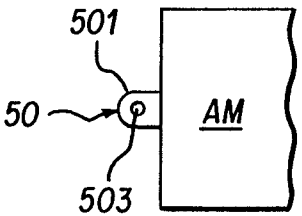
FIG. 54 PRIOR ART
FIG. 54 is a detail view of the connecting element or draWbar of the prior art trailer shown in FIG. 53.

FIG. 58 schematically illustrates an adapting flatcar FC connecting a freight container A of the present invention to a conventional freight container or intermodal trailer AM having a drawbar. Details of the conventional intermodal trailer AM are shown in FIGS. 53 and 54.

Figure 55:
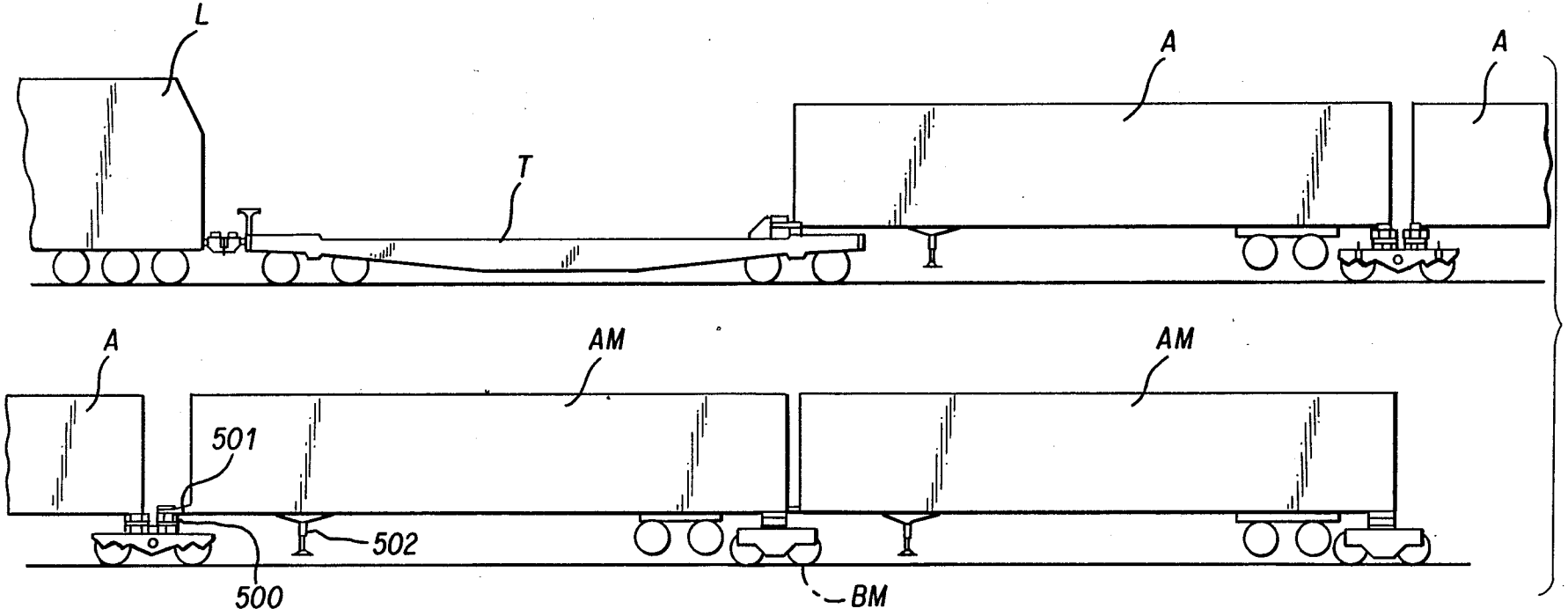
FIG. 55 is a side view showing the connections between a locomotive, intermodal trailers in accordance with the present invention and conventional bi-modal trailers.

FIG. 55 illustrates a train which includes a transition car T which is essentially constructed as an adapter car for connecting a conventional locomotive L to a freight container A of the present invention. An identical vehicle could be used to couple a conventional boxcar to the freight container A. However, a modified support structure constructed along the lines of the bogies described herein in the manner discussed above is necessary to accommodate a drawbar type container.

Figure 14:
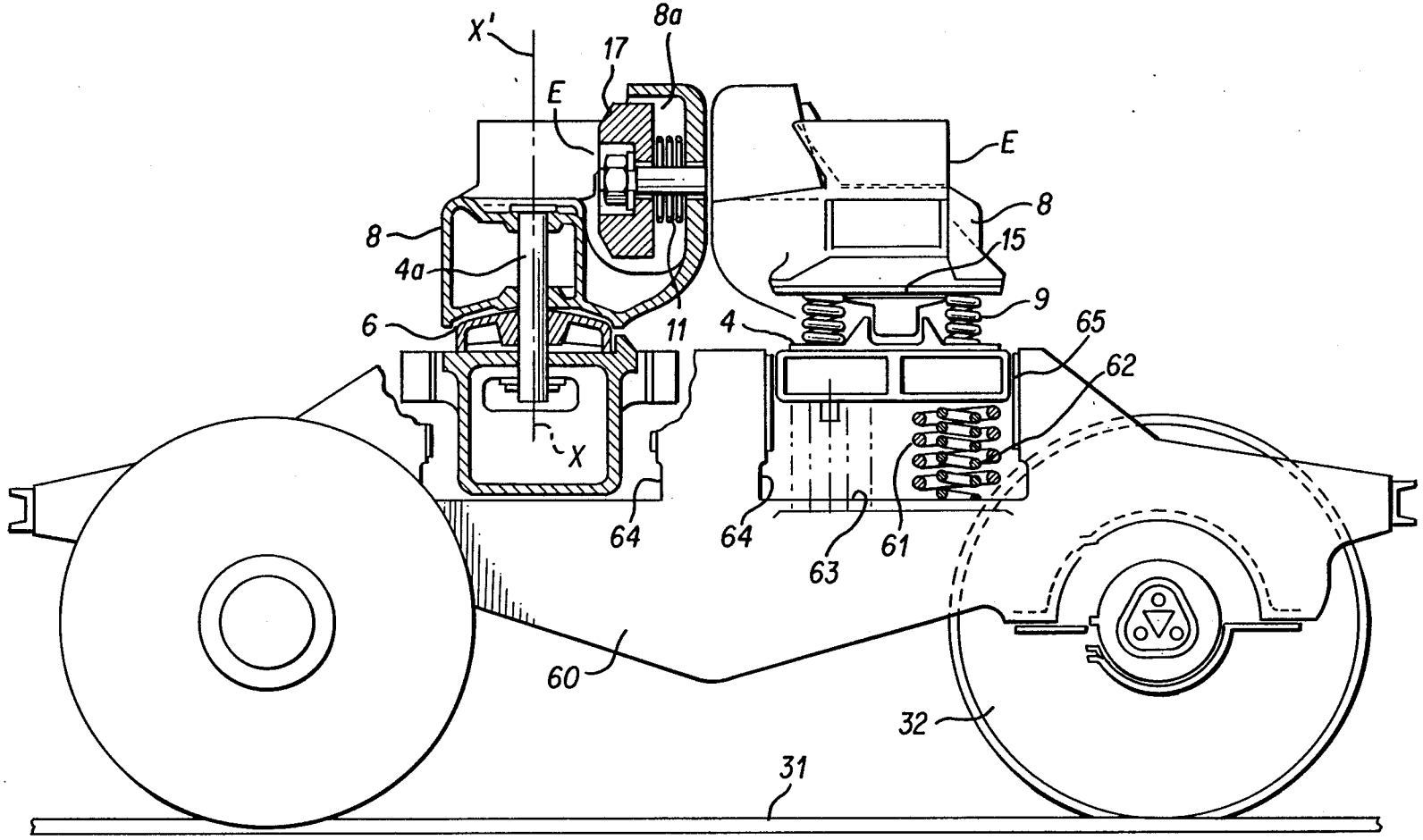
FIG. 14 is a side view with partial longitudinal cross sections of a different embodiment of a bogie according to the invention.

The variation of the embodiment shown in FIG. 14 differs from the one described above (FIGS. 4–11) essentially in that no spring suspension is provided between the chassis 60 and the wheels 32. Instead, a spring suspension 61, 62 is provided between the chassis 60 and the lower cross pieces 4. These springs 61, 62 press against a flat surface 63 placed in cavities 64 in the sole bars or side frames of the chassis 60. A friction shock absorbing system 65 is also provided.

Figures 15, 17:
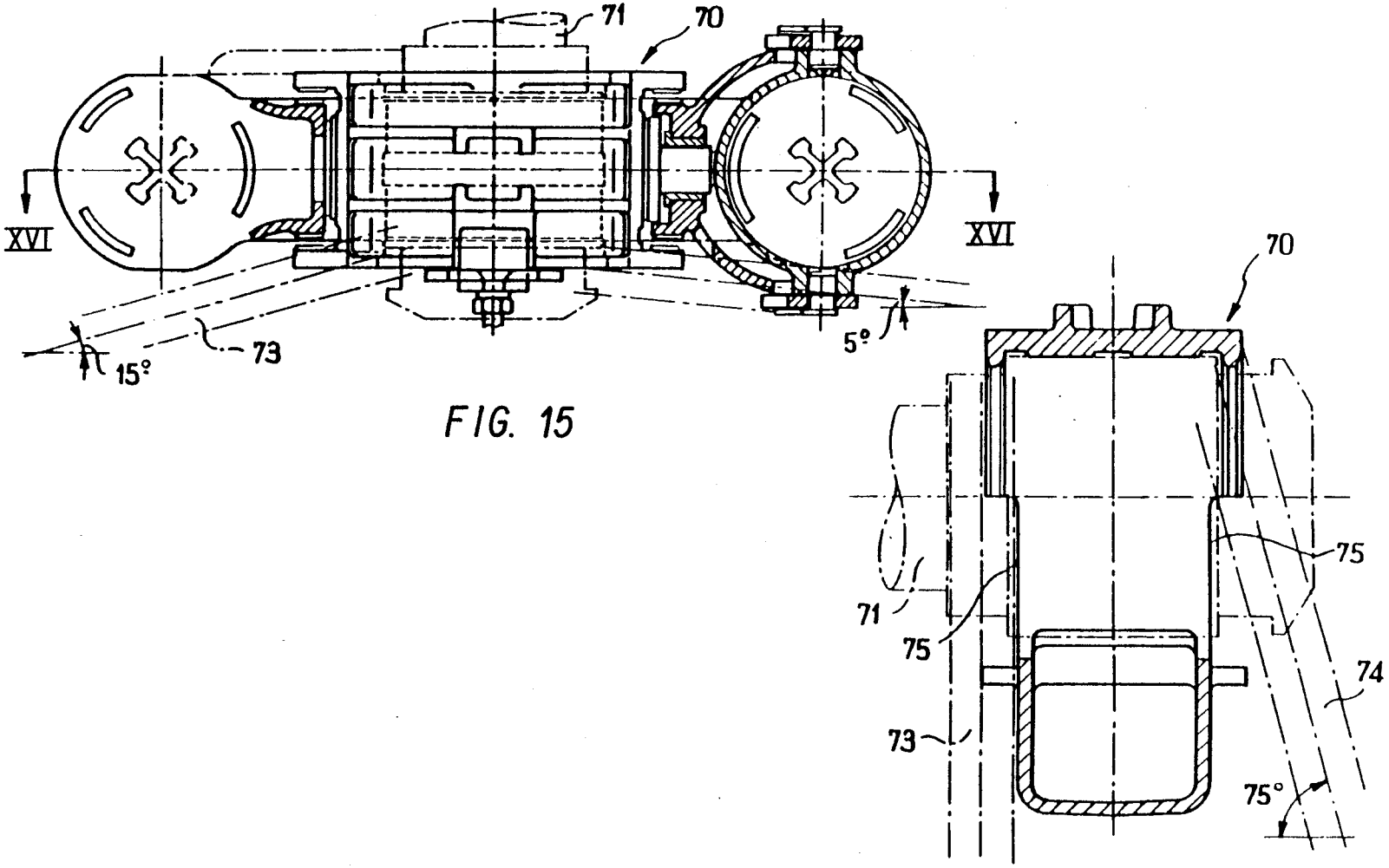
FIG. 15 is a cross section view along a horizontal plane of the bearing box of an angle of the bogie according to the invention.
FIG. 17 is a cross section view along line XVII—XVII of FIG. 16.
Figure 16:
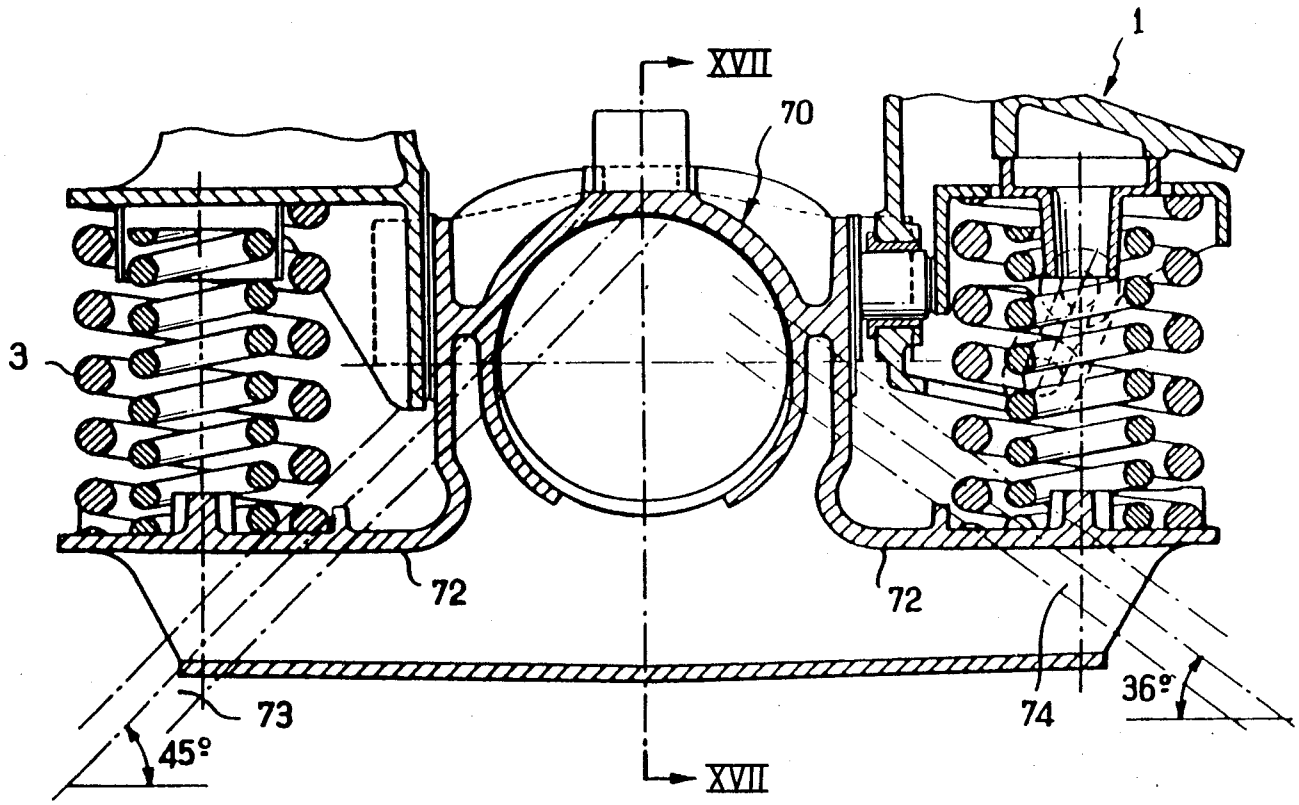
FIG. 16 is a cross section view along line XVI—XVI of FIG. 15.

The embodiment in FIGS. 15 and 16 shows a bearing box 70 in which the shaft 71 for the wheels of a bogie according to the invention is mounted in a rotating manner. This box 70 is made unitary with the element 72 against which press the suspension springs 3, which are inserted between this element 72 and a side frame 1 of the chassis (see FIG. 16).

According to a special characteristic of this invention, the bogie boxes 70 are made so that any heating of these boxes can be detected by radiation beams 73, 74 (infrared, for example) coming from fixed transmitters placed along the tracks.

For this purpose, each box 70 has on its lateral surface narrowed areas or cut-outs 75 sufficient (see especially FIG. 17) to allow the radiation beams coming from the tracks to reach the shaft 71 of the wheels on either side of the box, so that this radiation does hit into any metal walls that can absorb it in its path.

Figure 26:
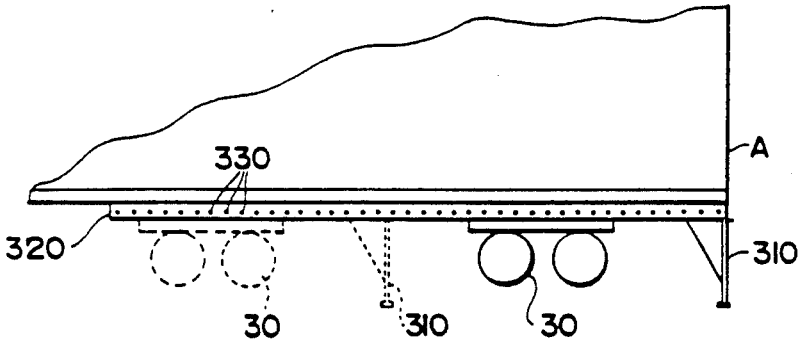
FIG. 26 is a schematic representation of the sliding step guard of and running gear of the present invention.
Figure 27:
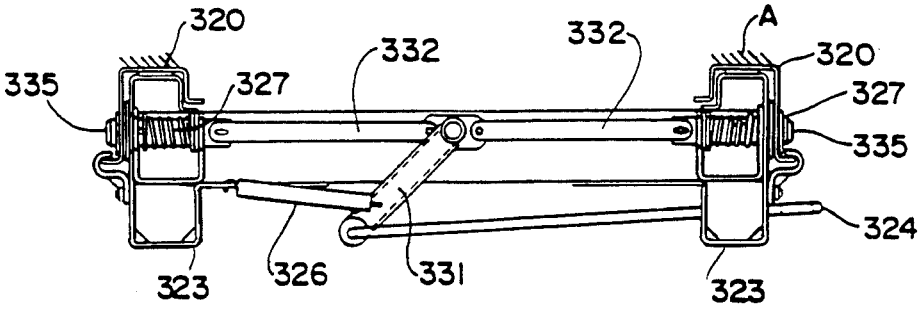
FIG. 27 is a side view of the locking pin operating means used to fix the position of the sliding step guard and running gear of FIG. 26.
Figure 28:
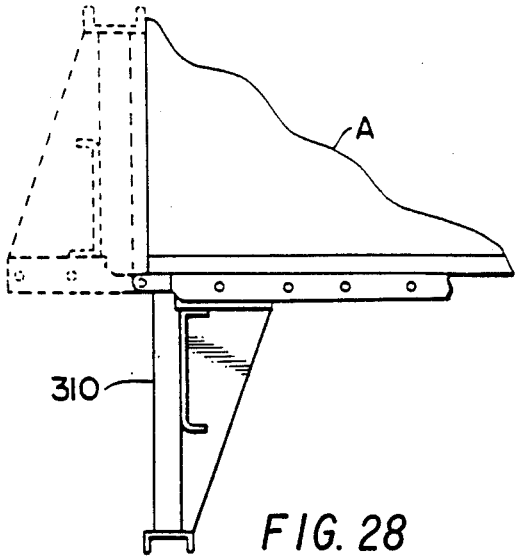
FIG. 28 is a schematic side view of a pivoting step guard arrangement.

Another aspect of the present invention is illustrated in FIGS. 26–28.

As shown in FIG. 26, the trailers A have a set of rear wheels disposed near the rear end thereof. Additionally, federal law mandates the provision of a step guard 310 at the rear end of road trailers. The typical positioning of the rear wheels 30 and the step guard 310 are illustrated in the phantom in FIG. 26. It is evident that if the rear wheels 30 and step guard 310 remain in the position shown in the phantom in FIG. 26, they would interfere with the connection of the bogie B and the trailers A. Accordingly, provision is made for repositioning the wheels or running gear 30 and the step guard 310 so that these components do not interfere with the connection between the trailers A and the bogie B.

The means for repositioning the running gear 30 is schematically illustrated in FIG. 26. In particular, a pair of longitudinal rail guides 320 having a series of openings 330 spaced along their length is secured to the bottom of the trailer A. The running gear 30 includes a portion which slides in the rail guides 320. The running gear 30 further carries a retractable pin means 335 which can be selectively engaged and disengaged in any of the openings 330 to fix the longitudinal position of the running gear 30. Thus, by disengaging the pins 335 from the openings 330, the running gear 30 can be repositioned from the position shown in solid lines in FIG. 26 to (for example) the position shown in phantom lines in FIG. 26 so as to avoid interference with the connection between the trailer A and bogie B.

Similarly, the step guard 310 may be provided with a portion which slides in the rail guides 320 and includes retractable pins 335. Such a step guard 310 could be repositioned from the position shown in solid in FIG. 26 to another position such as, for example, the position shown in phantom in FIG. 26. Of course, if desired, the sliding step guard 310 and the sliding running gear 30 could be fixed to one another so as to move in tandem.

FIG. 27 shows one possible retractable pin arrangement. In particular, the pins 335 are slidably supported in carriages 323 and controlled by a linkage 332, 331, 324 and a pair of compression springs 327. Each carriage 323 is formed of a plurality of components as shown in Figure 27 and slidably supported within the rail guides 320. The linkage includes a pair of link bars 332, a pivot 331 and a control handle 324.

The linkage is biased by a tension spring 326 into the position shown in FIG. 27. However, the linkage may be manually moved against the bias of tension spring 326 and compression springs 327 by manipulating handle 324 into a position where the control bars 332 slide away from the carriage 323 such that the pins 335 are retracted from the openings 330. When the handle 324 is released, the tension spring 326 and compression spring 327 return the linkage and pins 335 to the extended position. This retractable pin arrangement is well suited for use in connection with either the sliding running gear or the sliding step guard of FIG. 26.

FIG. 28 illustrates an alternative arrangement for repositioning the step guard 310. In particular, the step guard 310 may be made to pivot about the lower rear corner of the trailer A so that the step guard can be pivoted from the position shown in solid in FIG. 28 to the position shown in phantom lines in FIG. 28 so as to avoid interference with the connection between the trailer A and the bogie B. Of course, the step guard must be designed so that when in the up position shown in phantom lines in FIG. 28, it does not interfere with the upper portion of the bogie.

Figure 29:
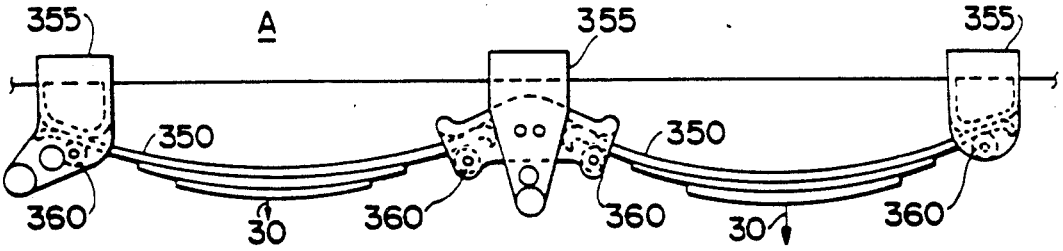
FIG. 29 is a schematic side view of modified leaf spring hangers.
Figure 30:
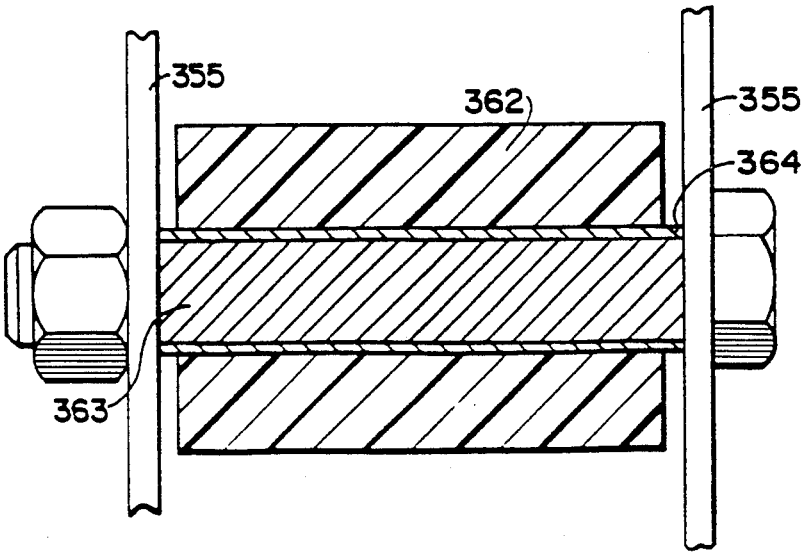
FIG. 30 is a cross section of a resilient bushing used in the modified leaf spring of FIG. 29.

FIGS. 29 and 30 illustrate another aspect of the present invention. Conventional trailers typically include leaf springs for supporting the wheels and axle assembly. FIG. 29 schematically represents such leaf springs 350 secured to the bottom of a trailer A. In normal road use, the weight of the trailer bears on the leaf springs such that the leaf springs 350 are generally in a partially stressed state. However, when the trailer is lifted off its wheels as in the present intermodal transport system, the weight of the trailer A no longer bears on the leaf spring 350 but instead, the weight of the wheels and axles bears on the leaf spring. Accordingly, the wheels sag from the lower surface of the trailer A. Such sagging can present problems when the wheels get to close to the level of the train tracks.

In order to inhibit or lessen the degree of sagging of the wheels and axles, the present invention contemplates the addition of resilient bushings 360 on the leaf spring hangers 355.

As shown in FIG. 29, the bushings 360 are placed on the hangers so as to inhibit sagging of leaf springs 350 under the weight of the wheels and axles by contacting portions of the leaf springs 350.

As a result of the unique construction of the resilient bushings, these bushings 360, while inhibiting sagging of the leaf springs 350 when the trailer A is elevated, do not interfere with the operation of the leaf springs when the leaf springs are supporting the weight of the trailer. This unique construction is shown in detail in FIG. 30.

As shown in FIG. 30, the resilient bushing 360 consists of a polyurethane cylindrical body 362 mounted on a metallic sleeve 364 Which is supported between a pair of leaf spring hangers 355 on a bolt 363. Since the polyurethane body is sufficiently rigid to withstand deflection under the force 30 applied by the sagging wheels and axles via the leaf spring, the polyurethane body 362 inhibits sagging of the leaf spring 355 under the weight of the wheels and axles 30. However, when the leaf spring 355 supports the weight of the trailer A, the polyurethane body 362 is easily deformed such that the resilient bushing 360 does not interfere with the normal flexing of the leaf spring 355.

In addition to the previously described bogie constructions, other constructions which achieve the objectives of this invention are possible. Examples of such alternative bogie constructions will be discussed hereinafter with reference to FIGS. 31–38.

Figure 31:
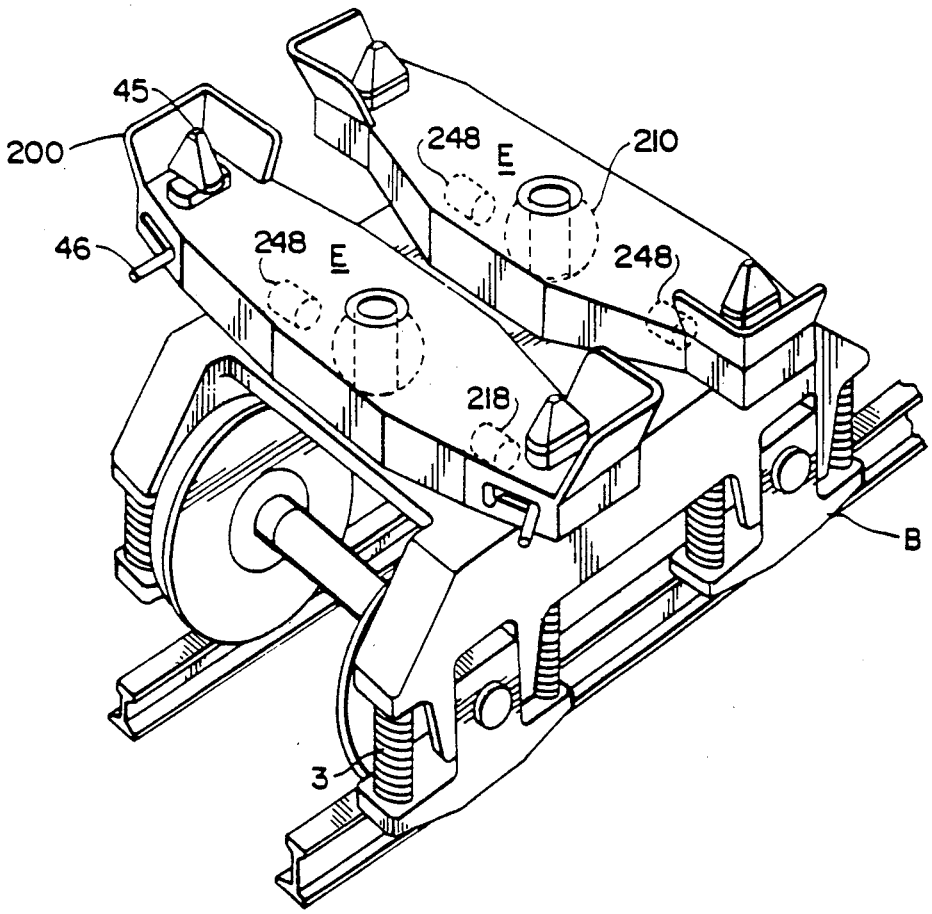
FIG. 31 is a perspective view of an alternative bogie construction.
Figure 32:
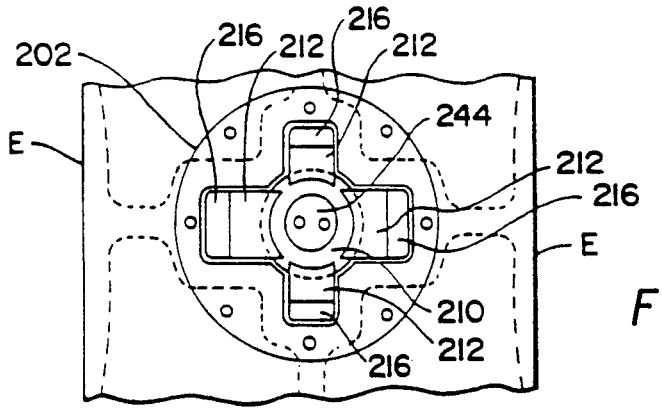
FIG. 32 is a top view of the articulated joint of the bogie construction of FIG. 31.
Figure 33:
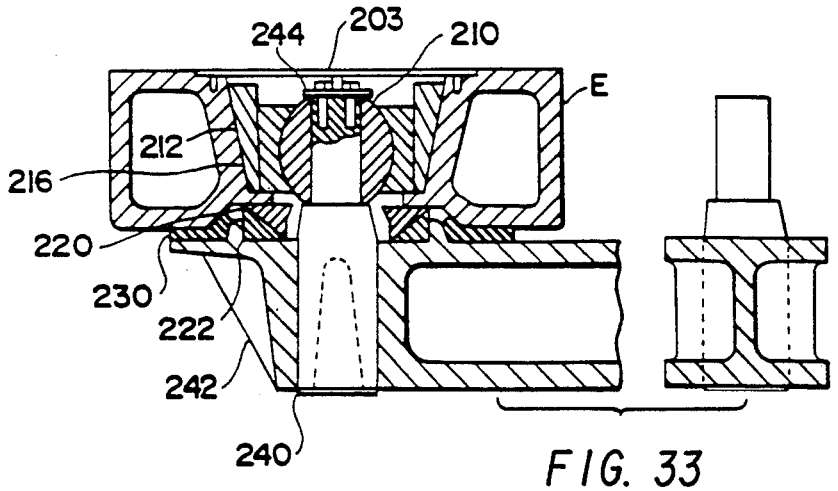
FIG. 33 is a cross section of the articulated joint of the bogie construction of FIG. 31.

The first alternative construction is illustrated in FIGS. 31–33. In this embodiment, the lower portion of the bogie is similar to the lower portion of the bogie described above and shown in FIGS. 4–6 for example. However, the bolster end portions E are mounted on the lower portion of the bogie via side bearings 248 and a spherical bearing and trunnion arrangement which will be described hereinafter. Further, the bolsters are provided with locking devices which may be of the twist-lock type, as shown, or of the previously described movable mass type (not shown).

The details of the spherical bearing and trunnion support arrangement are shown in FIGS. 32 and 33. A trunnion pin 240 is shrunk fit in a trunnion pin beam portion 242 of the bogie B. A concave, spherical ring seat 222 rests on an upper surface of the trunnion pin beam 242.

A combination leveling spring and dirt and grease seal 230 surrounds the concave spherical ring seat 222 and is bonded to the surface of the trunnion pin beam 242. A lower surface of the bolster E is bonded to the other side of the combination leveling spring and dirt and grease seal 230 so as to seal the space between the bolster end portions E and the trunnion pin beam 242.

A spherical ring 220 rests in the spherical ring seat 222 and supports a portion of the bolster E on its upper surface.

The trunnion pin 240 extends upwardly beyond the surface of the trunnion pin beam 242 and includes a narrow bearing receiving cylindrical portion. A spherical bearing 210 is keyed to the cylindrical bearing receiving portion of the trunnion pin 240. A retainer plate 244 is secured to the end of the trunnion pin 240 to retain the spherical bushing 210 on the trunnion pin 240.

A number of equispaced spherical bushing seats 212 having a concave inner surface bear on the outer surface of the spherical bearing 210 and have a planar outer surface. The planar outer surface of the spherical bushing seats 212 are in contact with wear take-up wedges or shims 216 which wedge between the planar outer surface of the spherical bushing seats 212 and a sloping surface of the bolster end portion E.

Finally, a cover plate 203 is provided in a recessed cover plate seat 202 to protect the interior of the bearing arrangement from excessive contamination.

With reference to FIG. 31, it can be seen that the trunnions, which are part of the truck frame structure, provide the bolster end portion E with pivotal freedom in the horizontal plane and transmit push-pull loads between bolsters. The spherical bearings 210 provide bolster self-alignment in all other planes against the force of elastomer springs 230. When the trailer is removed from the bolsters end portions E, these springs return the bolsters to a level position. Finally, side bearings 248 located on either side of the spherical bearing 210 provide the bolster with lateral stability.

One potential problem with the articulated bolster support shown in FIGS. 31–33 results from the eccentricity between the rotation center of the joint, defined as the rotation center of the spherical bearing 210, and the load transfer point from the rail trailer into the bolster defined by the load receiving point on the locking device. This eccentricity produces a twisting moment that must be absorbed.

Figure 34:
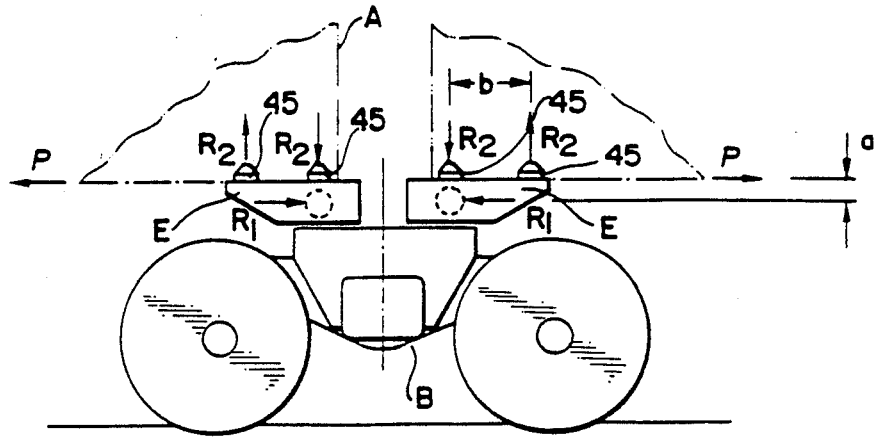
FIG. 34 is a schematic representation of a bogie construction transmitting the bolster twisting moment to the trailer body.
Figure 35:
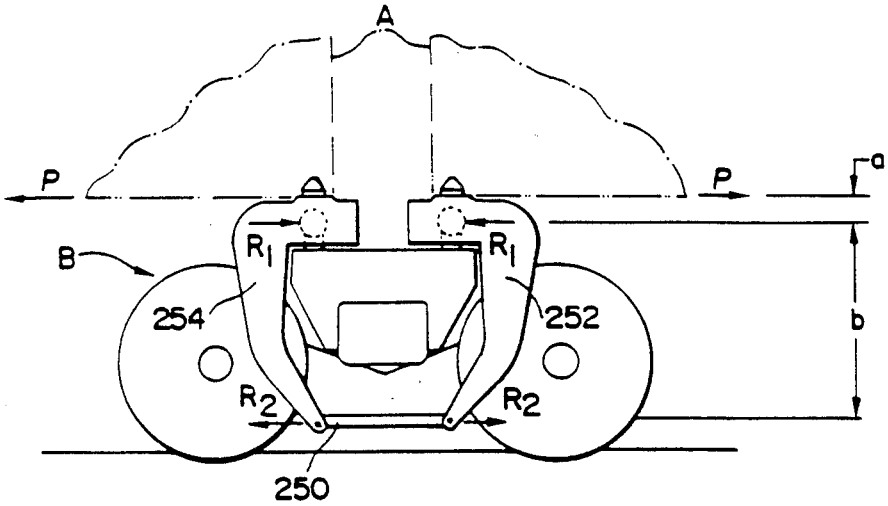
FIG. 35 is a schematic representation of a bolster twisting moment absorbing bogie construction.

FIGS. 34 and 35 schematically illustrate two possible arrangements for absorbing the twisting moment produced by the eccentricity of the rotation center of the spherical bearing and the load transfer point from the rail trailer into the bolster.

In FIG. 34, four locking devices 45 connect each trailer end to each bolster end portion E. Thus, as shown in FIG. 34, each trailer side end has two locking devices 45, such as twist locks, connecting it to the bolster end portion E. Through the provision of the additional twist lock, the moment generated by the pulling force P and the reaction force $R_1$ on the spherical bearing is absorbed in the trailer by reaction forces $R_2$ acting at the connection between the locking devices and the trailer end. It should be noted that this means of absorbing the twisting moment requires considerable strengthening of the rail trailer structure because the moment is essentially transmitted into the rail trailer.

In FIG. 35, the moment is taken out in the bogie or rail truck B. In accordance with this embodiment, connecting rod 250 and connecting levers 254 and 252 allow the moment to be transmitted into the bogie B. More specifically, reaction forces $R_2$ are generated at the connection between the levers 254, 252 and the connecting rod 250. As a result of these reaction forces, the moment is absorbed in the bogie.

It should be noted, however, that: in the embodiment of FIG. 35 , there must be some articulation or play between the trailer A and the bolster E at their interface, resulting in accelerated wear. Further, the bolster articulation in the front-aft plane must be restrained during application of the brakes. These problems could be obviated to some degree by the provision of a mechanical snubber assembly between the connecting rod 250 and the lower portion of the bogie such that the lower portion of the bogie absorbs some forces. Such a snubber assembly could also be provided with a compression spring for absorbing additional force.

Figure 36:
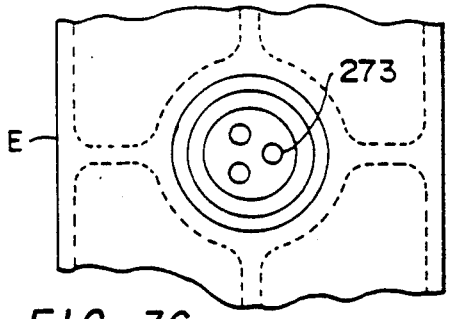
FIG. 36 is a top view of the articulated joint of a modified bogie construction.
Figure 37:
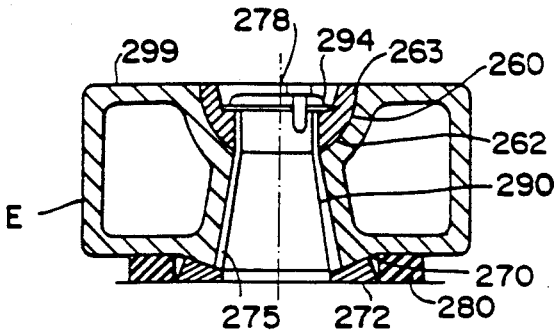
FIG. 37 is a cross section of the articulated joint of FIG. 36.

While as discussed above, it is possible to absorb the moments generated through the use of an articulated bolster support arrangement of the type shown in FIGS. 31-33, it is, of course, desirable to lessen the moment produced to the greatest extent possible. Accordingly, the semi-spherical joint construction illustrated in FIGS. 36-37 is considered particularly advantageous since, with this arrangement, the rotation or pivot center of the joint between the bolster and the lower portion of the bogie is located substantially at the uppermost surface of the bolster end portion E on which the trailer rests. The details of this semi-spherical joint arrangement will be discussed hereinafter with reference to FIGS. 36 and 37.

As with the joint construction of FIGS. 32 and 33, the trunnion pin 290 of the semi-spherical joint is fixedly secured to the lower portion of the bogie B (connection not shown). A concave, spherical ring seat 272 rests between the lower portion of the bogie (not shown) and a convex spherical surface 270 of the bolster end portion E. A combination bolster leveling spring and dirt and grease seal 280 surrounds the spherical ring seat 272 and seals the area between the bolster end portion E and the lower portion of the bogie. Preferably, the combination leveling spring and seal 280 is bonded to both the lower portion of the bogie and the bolster end portion E.

The trunnion 290 extends upward of the lower portion of the bogie into an opening in the bolster such that a spacing 275 is provided Which allows pivoting of the bolster end portion E above the trunnion 290.

As shown in FIG. 37, the trunnion 290 is tapered and includes a cylindrical uppermost portion. The bolster end portion E includes a concave semi-spherical surface 262 into which surface rests a convex semi-spherical bearing cap 260. The convex semi-spherical bearing cap 260 is secured to the trunnion 290 via a flanged bearing sleeve 263, a combination thrust bearing and retainer plate 294, and drilled head, wire secured bolts 273 which are adjustable for wear.

As is evident from FIG. 37, the semi-spherical joint construction allows the bolster to pivot about the convex semi-spherical bearing cap 260 of the trunnion assembly. The center 278 of the pivoting motion is located at the uppermost edge of the spherical cap 260 which corresponds to the uppermost surface of the bolster E.

Since the uppermost surface 299 of the bolster end portion E is proximate the load transfer point from the trailer into the bolster, the eccentricity between the rotation center of the bolster support joint and the load transfer point from the trailer into the bolster is virtually eliminated by this construction. Accordingly, the twisting moment generated by the pulling force is minimized or eliminated.

Figure 38:
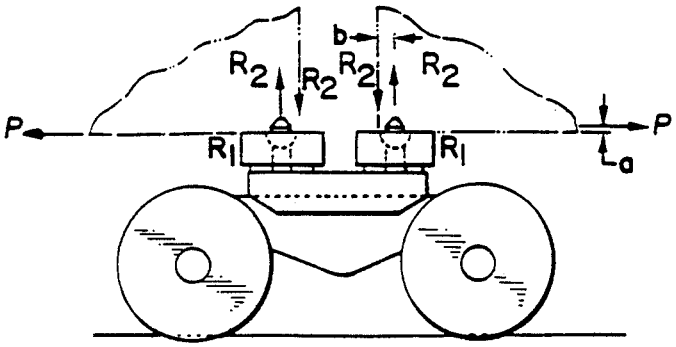
FIG. 38 is a schematic representation of the forces acting on a bogie modified to include the articulated joint of FIGS. 36 and 37.

FIG. 38 schematically illustrates the forces applied to the various components when the semi-spherical joint is employed. More specifically, the pulling force P results in a reaction force $R_1$ which is vertically only a very small distance from the load transfer point of the force P. Accordingly, the reaction forces $R_2$ necessary to counteract the relatively small moment generated by the opposed forces P and $R_1$ are small enough that a single twist lock at each bolster end will have ample strength to transfer the remaining very small twisting moment from the bolster into the trailer.

Of course, it is possible that the semi-spherical joint of FIGS. 36 and 37 could be employed in conjunction with the moment absorbing arrangements illustrated in Figures 34 and 35, if necessary or desired.

As previously noted, in some instances it is desirable to couple freight containers A of the present invention to dissimilar freight containers such as those used in conventional intermodal or bi-modal systems. As also noted above one such system employs drawbar type freight containers. An example of such a drawbar trailer AM is illustrated in FIGS. 53 and 54.

As shown in FIGS. 53 and 54, the conventional trailer AM includes a drawbar 501 which as schematically illustrated in FIG. 54 includes a pin receiving opening 503. The drawbar 501 can be coupled to either a highway vehicle via a king pin or a locomotive via a deadman or transition vehicle so that the trailer may be moved in either a highway mode or a rail mode.

The trailer AM is also provided with a road wheel system 30 for highWay use and a rail axle for rail use. The rail Wheels and/or the road wheels may be retractable such that when one wheel set is to be used, the other wheel set is elevated. The rear end of the trailer of such a system typically includes a drawbar receiving and supporting structure.

There are several ways of achieving compatibility between the intermodal system of the present invention and conventional intermodal systems of the type illustrated in FIGS. 53 and 54. One such method of achieving compatibility is through the use of adapter cars of the type described above.

Another way of achieving compatibility is through the use of a simple adapter bolster of the type shown in FIGS. 52(A)–(D) on one of the bogies of the present invention.

As shown in the various views of FIGS. 52(A)–(D), the adapter bolster 500 includes lock receiving openings 544 which allow the bolster to be secured to the bogies of the present invention via twist locks or the like. The bolster 500 also includes a drawbar receiving opening 504 having a wedge shape to permit the introduction of the drawbar 501 of the trailer AM. The bolster 500 also includes a pin receiving opening 505 which intersects the drawbar receiving opening 504.

In use, the bolster 500 is secured to a bogie at the openings 544 and the drawbar 501 of the trailer or container AM is received in the opening 504 and secured therein by a pin or the like extending through the openings 503 and 505 of the drawbar and bolster, respectively. If it is necessary to adjust the elevation of the drawbar to that of the drawbar receiving opening 504, the lifting means associated with the support leg 502 of the container AM may be employed.

Figure 46A:
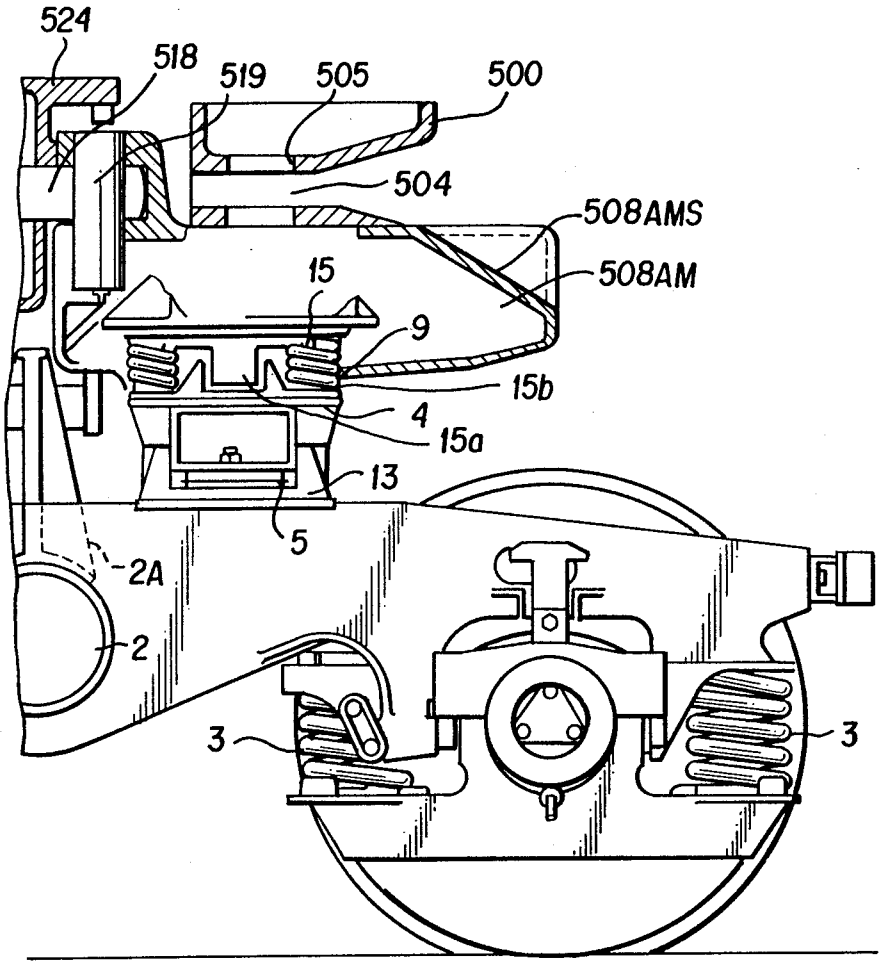
FIG. 46(A) is a half cross-section of the bogie shown in FIG. 45(A) along the longitudinal phase of symmetry.
Figure 45A:
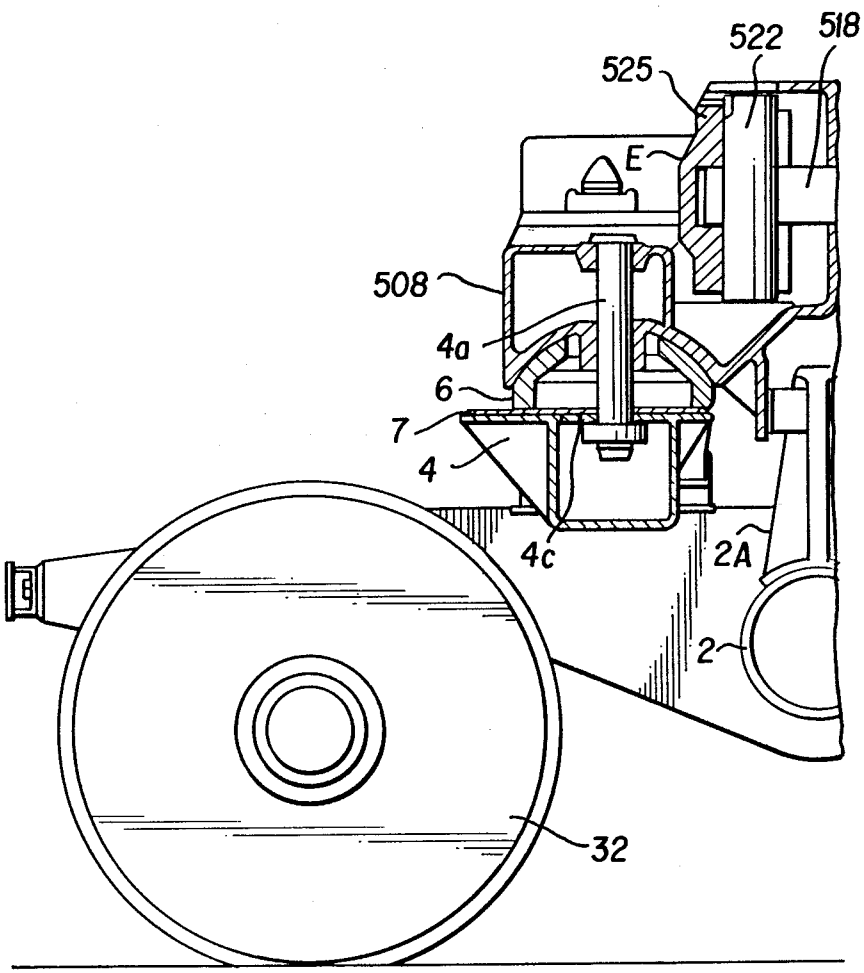
FIG. 45(A) is a half side view of a modified bogie similar to the bogie shown in FIG. 45.

FIGS. 45(A)–50(A) illustrate a bogie construction on which the adapter bolster 500 is attached. The bogie construction is identical to that of FIGS. 45–50 with one significant exception. Specifically, the upper bolsters 508 AM have been modified to include a sloped wedge portion 508 AMS. In the illustrated embodiment, only one of the upper bolsters is modified to include the sloped wedge portion. However, it is possible, indeed preferable, that both upper bolsters include such a sloped wedge portion. In fact, it is preferred that, to the greatest extent possible, all of the bogies of the present invention include sloped wedge portions on both of the upper bolsters. This is because the provision of the sloped wedge portion offers a significant compatibility advantage without adversely affecting operation. Specifically, as best illustrated in FIG. 46A, the sloped wedge portion 508 AMS provides a drawbar guide path such that when the elevation of the drawbar 501 is less than that of the drawbar receiving opening 504 and the drawbar 501 is advanced toward the bolster 500, the sloped wedge portion 508 AMS guides or cams the drawbar upwardly into the opening 504. By virtue of this modified upper bolster, the need to use the means associated with the support leg 502 to lift the trailer is reduced or obviated.

As described above, the provision of the bolster adapter 500 on a bogie as illustrated for example in Figures 45(A)–50(A) allOws the bogies of the present invention to support the drawbars of intermodal trailers or containers. There are, however, some instances where in addition to mechanical coupling compatibility, it is necessary to provide compatibility between dissimilar air supply systems. In such instances, it is useful to provide an auxiliary air supply reservoir (not shown) in the adapter bolster or at some other location proximate the connection between dissimilar systems. This is also true with respect to the other compatibility arrangements discussed herein. In other words, the member used to couple dissimilar trailers must include means such as an auxiliary air supply system to compensate for different air supply requirements of the dissimilar intermodal systems.

FIGS. 59–62 illustrate another means of achieving compatibility between the intermodal system of the present invention and intermodal or bi-modal systems of the type described above with reference to FIGS. 53 and 54. In accordance with this method, an adapter trailer or car AC is provided. The adapter trailer has a drawbar 501 at one end thereof and twist lock receiving openings 544 at the other end thereof. The trailer AC may be coupled to a conventional intermodal trailer AM of the type described with reference to FIGS. 53 and 54 through its drawbar 501. Moreover, the trailer may be coupled at its other end to any of the bogies of the present invention through the twist lock openings 544. Thus, the adapter trailer AC may be coupled between conventional intermodal trailers and bogies of the present invention thereby providing compatibility between the two systems.

Figure 60:
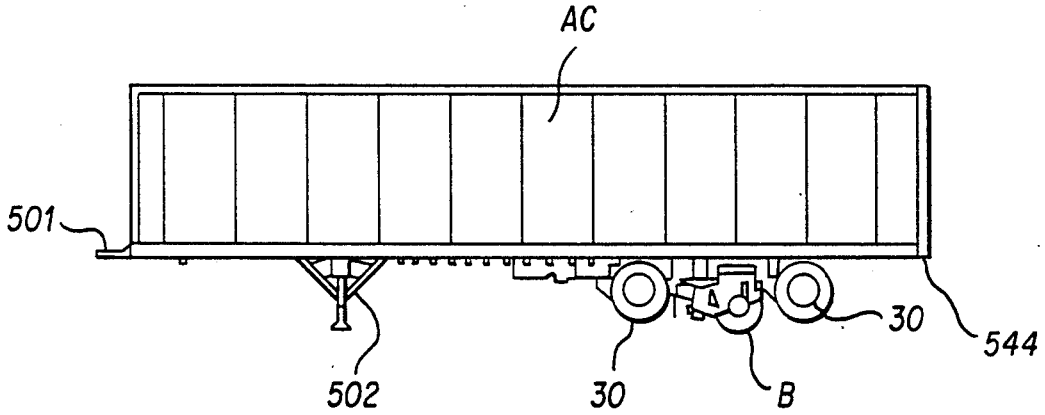
FIG. 60 is a side view of another adapter trailer according to the present invention.
Figure 62:
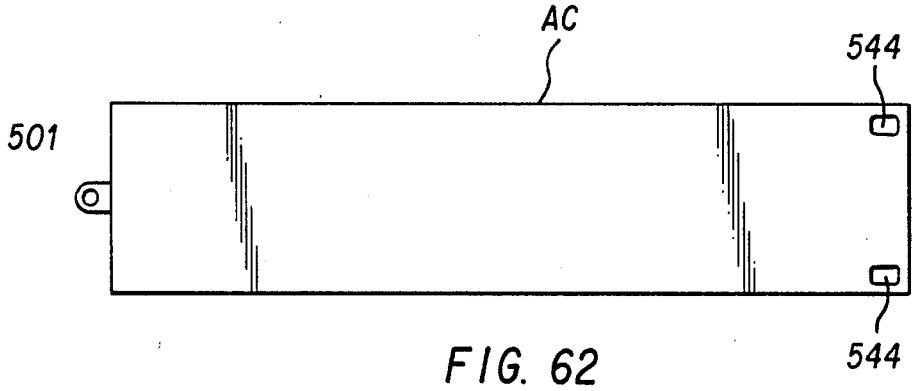
FIG. 62 is a bottom view of the adapter trailers of FIGS. 59, 60 and 61 showing only the trailer bottom and connection means.
Figure 61:
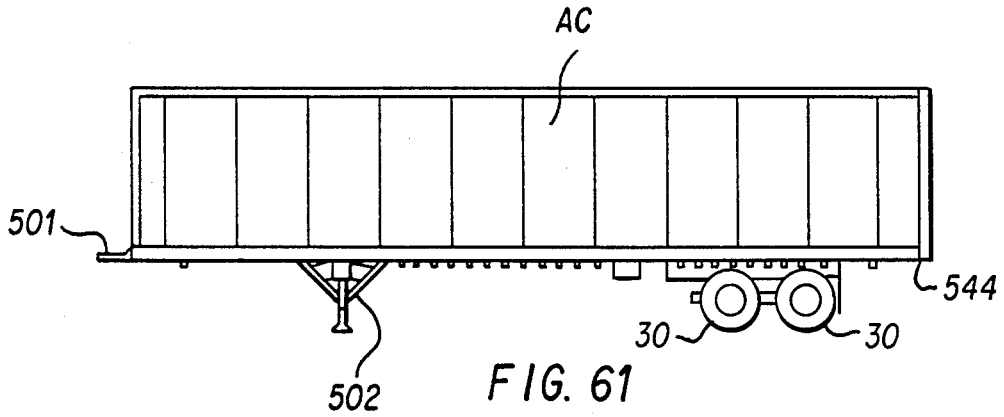
FIG. 61 is a side view of another adapter trailer according to the present invention.

As illustrated in FIGS. 60 and 61 the adapter container may include a support leg 502 which can include convention means for lifting the car AC.

As further illustrated in FIGS. 60 and 61 the adapter car 60 may also include highway and/or rail wheel systems. However, in order to facilitate mounting of the rear end of the container or car AC on the bogies of the present invention, the wheels must be mounted or movable to a position sufficiently forward of the twist lock receiving openings 544 to permit mounting on a bogie. The simplest solution is fixedly mounting the wheels at the forward position. However, when this is not practical, the wheels may be slidably mounted on the bottom of the container or trailer in, for example, the manner described above with reference to the sliding step guard and running gear.

What is claimed is:

1. A bogie intended to be placed between the ends of two road trailers at least one of which has a drawbar extending from a longitudinal end thereof, the bogie including a rigid chassis having first and second ends mounted on rail wheels, said first and second ends of said chassis having first and second supports, respectively, to accommodate an end of a supported member, said first support supporting a first supported member and said second support supporting a second supported member, said first support including means to attach said supported member to said support in a removable manner, said first supported member comprising a freight container and said second supported member comprising an adapter bolster, said adapter bolster comprising a drawbar receiving opening and means for retaining the drawbar of the road trailer in said opening and each of said first and second supports being connected to the chassis by fastening means allowing a predetermined freedom of movement of the supports with respect to the chassis around the following three axes: the axis perpendicular to the horizontal plane of the chassis, the axis parallel to the longitudinal axis of the chassis and the axis perpendicular to the vertical longitudinal plane of symmetry of the chassis.

2. A bogie intended to be placed between the ends of two trailers, at least one of the trailers including a drawbar extending longitudinally from a longitudinal end of said trailers, said bogie including a rigid chassis having two ends mounted on railroad wheels, a first one of the two ends of the chassis having a support which includes a trailer support surface to accommodate an end of a trailer, said support including means to attach said trailer end to said support in a removable manner, a second one of the two ends of the chassis having a support which includes an adapter bolster support surface to accommodate an adapter bolster, said adapter bolster including means for releasably supporting a trailer drawbar and each of said two supports being pivotably connected to the chassis such that said supports pivot about a point which is substantially coplanar with the trailer support surface.

3. A bogie intended to be placed between the ends of two road trailers each of which has a wheel and axle assembly, at least one of said road trailers including a drawbar, said bogie supporting said road trailers at a predetermined height above the ground so that the wheel and axle assemblies of the trailers are located a predetermined distance above the ground, the bogie comprising a rigid chassis mounted on wheels, said chassis having two ends, each of said two ends of the chassis including a support to accommodate a supported member, each support having a locking device to releasibly attach said supported member to said support, a first one of said supported members comprising a road trailer and a second one of said supported members comprising an adapter bolster, said adapter bolster including a drawbar receiving opening for releasably securing the drawbar of said at least one road trailer, each of the two supports being connected to the chassis by fastening devices allowing a predetermined freedom of movement of said supports with respect to the chassis around the following three axes: the axis perpendicular to the horizontal plane of the chassis, the axis parallel to the longitudinal axis of the chassis and the axis perpendicular to the vertical longitudinal plane of symmetry of the chassis.

4. The bogie of claim 3 wherein said adapter bolster includes lock receiving openings for receiving said locking device so as to secure said adapter bolster to said bogie, at least one drawbar receiving opening for receiving the trailer drawbar, said adapter bolster further comprising a drawbar locking device for locking said drawbar in said drawbar receiving opening.

5. A bogie intended to be placed between the ends of two road trailers, each said trailer comprising two longitudinal ends and a pair of substantially parallel side walls, one of said two trailers being supported by the bogie at a first longitudinal end and by a second bogie at a second longitudinal end, locking means located proximate the corners of one of said two longitudinal ends of the freight container, said locking means releasably securing said one end of said trailer to a first bogie such that forces transferred between said locking means at points proximate the sidewalls of the trailer, said second longitudinal end of said trailer including a drawbar, the second bogie having an adapter bolster releasibly secured thereto, the adapter bolster having a drawbar receiving opening and said drawbar being releasibly secured in the drawbar opening such that the drawbar is operatively supported on and pivotably secured with respect to the second bogie.

* * * * *

UNITED STATES PATENT AND TRADEMARK OFFICE

CERTIFICATE OF CORRECTION

PATENT NO. : 4,955,144

DATED : 11 September 1990

INVENTOR(S) : Jean LIENARD et al.

It is certified that error appears in the above-identified patent and that said Letters Patent is hereby corrected as shown below:

| Column | Line | |
|---|---|---|
| 1 | 12 | Delete "ID". |
| 1 | 13 | Change "adVantages" to --advantages--. |
| 1 | 67 | Change "Which" to --which--. |
| 2 | 28 | Change "Cited" to --cited--. |
| 4 | 40 | Change "bOgie" to --bogie--. |
| 4 | 51 | Change "shook" to --shock--. |
| 6 | 46 | Delete "17". |
| 6 | 50 | Change "an" to --a--. |
| 7 | 20 | Change "draWbar" to --drawbar--. |
| 8 | 26 | Change "B" to --8--. |
| 8 | 46 | Change "FIGS. 6 o" to --FIGS. 6--. |
| 8 | 50 | Delete "13". |
| 9 | 12 | After "frames" insert --1--. |
| 10 | 59 | Delete "and". |
| 11 | 11 | Change "While" to --while--. |
| 11 | 24 | Before "bolt" insert --a--. |
| 12 | 5 | Change "shoWn" to --shown--. |
| 13 | 23 | Change "With" to --with--. |
| 14 | 57 | Change "comprise" to --comprises--. |

UNITED STATES PATENT AND TRADEMARK OFFICE

CERTIFICATE OF CORRECTION

PATENT NO. : 4,955,144

DATED : 11 September 1990

INVENTOR(S) : Jean LIENARD et al.

It is certified that error appears in the above-identified patent and that said Letters Patent is hereby corrected as shown below:

| Column | Line | |
|---|---|---|
| 15 | 2 | Change "Wedge" to --wedge--. |
| 15 | 31 | Change "level" to --lever--. |
| 15 | 51 | Change "preferable" to --preferably--. |
| 15 | 59 | Change "slOping" to --sloping--. |
| 15 | 63 | Change "10" to --106--. |
| 16 | 17 | Before "integral" insert --or--. |
| 17 | 68 | Delete ", it is also" and insert --without--; after "trailers" (second occurrence) insert --,--. |
| 18 | 1 | After "feature" insert --,--. |
| 18 | 2 | After "located" insert --trailer--. |
| 18 | 5 | After "string" change "o" to --of--. |
| 18 | 11 | Delete "is"; after "supported" insert --it,--. |
| 18 | 29 | Change "parallel piped" to --parallelepiped--. |
| 20 | 19 | After "553" change "of" to --or--. |
| 20 | 23 | Change "pivotable" to --pivotably--. |

UNITED STATES PATENT AND TRADEMARK OFFICE

CERTIFICATE OF CORRECTION

PATENT NO. : 4,955,144

DATED : 11 September 1990

INVENTOR(S) : Jean LIENARD et al.

It is certified that error appears in the above-identified patent and that said Letters Patent is hereby corrected as shown below:

| Column | Line | |
|---|---|---|
| 20 | 26 | After "such" insert --that--. |
| 21 | 12 | After "does" insert --not--. |
| 22 | 46 | Change "Which" to --which--. |
| 24 | 58 | Change "Which" to --which--. |
| 25 | 46 | Change "highWay" to --highway--. |
| 25 | 47 | Change "Wheels" to --wheels--. |
| 26 | 39 | Change "allOws" to --allows--. |
| 27 | 5 | Change "convention" to --conventional--. |
| 28 | 47 | Before "locking" insert --trailer and the bogie are transferred via said--. |

Signed and Sealed this

Fourteenth Day of July, 1992

*Attest:*

*Attesting Officer*

DOUGLAS B. COMER

*Acting Commissioner of Patents and Trademarks*